US006926649B2

(12) United States Patent
Slawinski

(10) Patent No.: US 6,926,649 B2
(45) Date of Patent: Aug. 9, 2005

(54) SELF-SPOTTING APPARATUS FOR FREE-WEIGHTS

(76) Inventor: Michael D. Slawinski, 1601 Wickersham Pl., Suwanee, GA (US) 30024

( * ) Notice: Subject to any disclaimer, the term of this patent is extended or adjusted under 35 U.S.C. 154(b) by 21 days.

(21) Appl. No.: 10/600,277

(22) Filed: Jun. 21, 2003

(65) Prior Publication Data

US 2004/0192519 A1 Sep. 30, 2004

Related U.S. Application Data

(60) Continuation-in-part of application No. 10/397,744, filed on Mar. 25, 2003, which is a continuation-in-part of application No. 09/957,152, filed on Sep. 20, 2001, now Pat. No. 6,537,182, which is a division of application No. 09/385,241, filed on Aug. 28, 1999, now Pat. No. 6,293,892.

(51) Int. Cl.[7] ..... A63B 21/072

(52) U.S. Cl. ..... 482/104; 482/4; 482/98; 482/106

(58) Field of Search ..... 482/4, 93, 94, 482/98, 99, 101–104, 106, 108, 135, 138

(56) References Cited

U.S. PATENT DOCUMENTS 3,235,255 A * 2/1966 Leflar ..... 482/104
3,866,914 A * 2/1975 Jackson ..... 482/98
4,324,398 A * 4/1982 Hole ..... 482/104
4,561,651 A * 12/1985 Hole ..... 482/104
4,750,739 A * 6/1988 Lange ..... 482/104
4,934,693 A * 6/1990 Santoro ..... 482/98
4,998,723 A * 3/1991 Santoro ..... 482/104
5,050,868 A * 9/1991 Pearson ..... 482/94
5,108,354 A * 4/1992 Becker ..... 482/104
5,184,992 A * 2/1993 Banks ..... 482/104
5,273,506 A * 12/1993 Dawson, Jr. ..... 482/104
5,407,403 A * 4/1995 Coleman ..... 482/104
5,468,203 A * 11/1995 Okonkwo ..... 482/104
5,669,859 A * 9/1997 Liggett et al. ..... 482/94
5,788,616 A * 8/1998 Polidi ..... 482/104
5,842,961 A 12/1998 Davis
5,971,897 A * 10/1999 Olson et al. ..... 482/101
6,293,892 B1 9/2001 Slawinski et al.
6,379,287 B1 * 4/2002 Slawinski et al. ..... 482/104
6,537,182 B2 * 3/2003 Slawinski et al. ..... 482/104
2002/0077224 A1 6/2002 Slawinski et al.

* cited by examiner

*Primary Examiner*—Jerome W. Donnelly
*Assistant Examiner*—Victor K. Hwang
(74) *Attorney, Agent, or Firm*—Kenneth S. Watkins, Jr.

(57) ABSTRACT

A self-spotting apparatus for free-weights [2301] utilizes a pair of weight-responsive engagement assemblies [1203A, 1203B] engaging a respective pair of support columns [1207A, 1207B] to provide engageable support for a free-weight bar [2311]. Auxiliary stops [2203A, 2203B] limit the lowest position of the free-weight bar. The auxiliary stops are adjustable by manual or electrical disengagement from the support columns. A control unit [2302] provides disengagement logic for barbells and dumbbells.

14 Claims, 24 Drawing Sheets

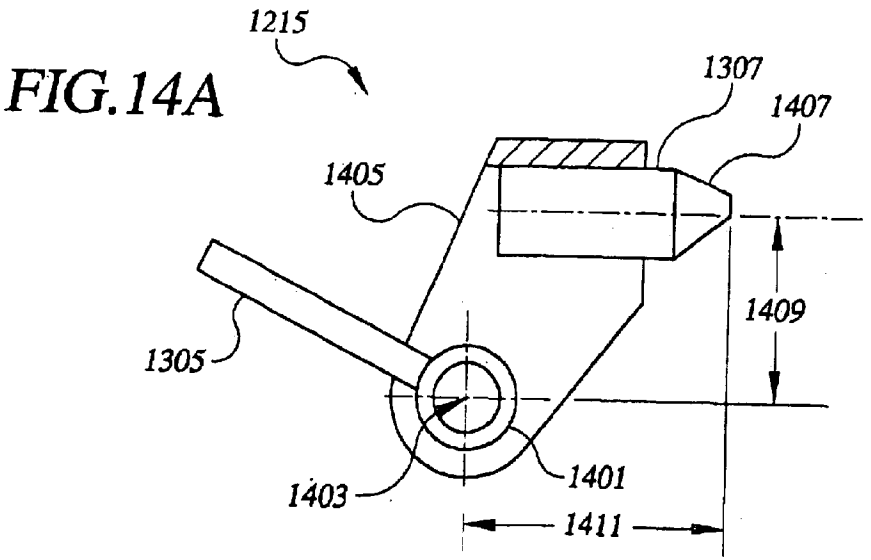
FIG.14A
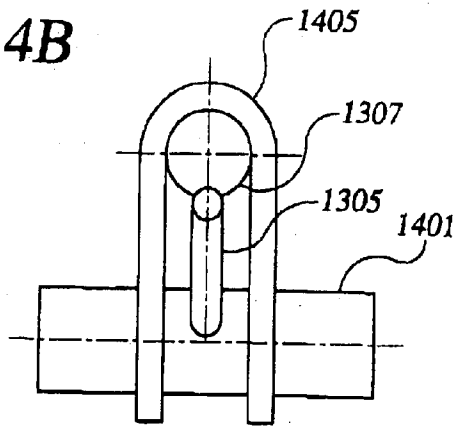
FIG.14B
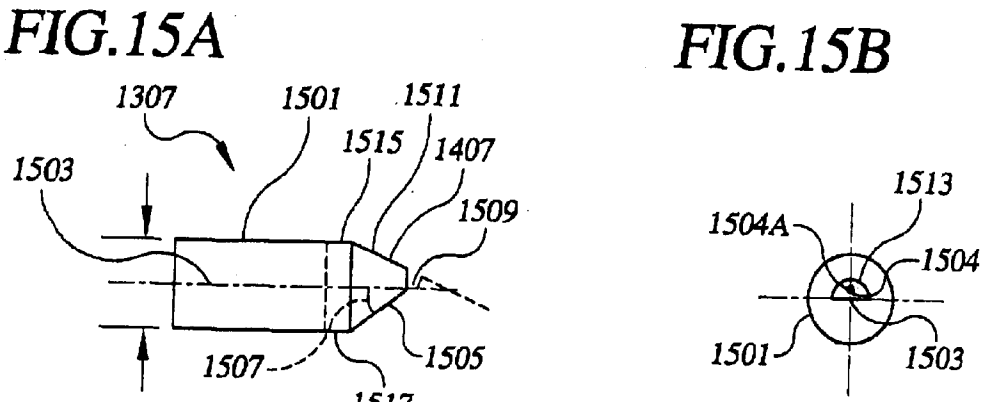
FIG.15A
FIG.15B
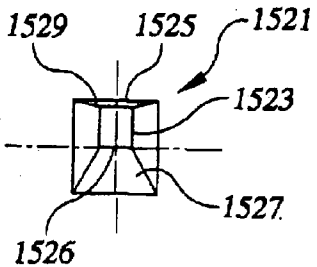
FIG.15C

SELF-SPOTTING APPARATUS FOR FREE-WEIGHTS

This application is a continuation-in-part application of U.S. application Ser. No. 10/397,744 filed on Mar. 25, 2003 currently pending, which is a continuation-in-part of U.S. application Ser. No. 09/957,152, filed on Sep. 20, 2001 issued as U.S. Pat. No. 6,537,182, which is a divisional application of U.S. application Ser. No. 09/385,241, filed on Aug. 28, 1999 issued as U.S. Pat. No. 6,293,892.

BACKGROUND OF THE INVENTION

1. Field of the Invention

The present invention relates to the field of exercise equipment and, more particularly, to a self-spotting apparatus for free-weights.

2. Description of the Related Art

Despite the variety of exercise and muscle-building equipment and activities available, free-weight lifting continues to be the workout method of choice for many athletes. Free-weight lifting allows unrestrained motion during lifting, closely approximating application of human strength in many recreation and sporting activities. Selection of weights utilized in free-weight lifting is highly repeatable as compared to machines employing levers, cams, and resistance elements such as springs and hydraulic or pneumatic cylinders. Also, free-weights provide uniform resistance unaffected by wear of mechanical parts and other components.

One disadvantage limiting use of free-weights is the need for one or more spotters, especially in strength regimens that push the strength and endurance limits of the user. These regimens are most effective when the user continues repetitions until he or she is unable to lift the weight. This is a safety concern if spotters are not immediately available since the user may be unable to safely lift the weight to a support device. Even when spotters are available, they may not recognize an unsafe condition, or, their response may not be quick enough to prevent injury.

Self-spotting machines, disclosed by others, have addressed eliminating the need for one or more spotters. For example, U.S. Pat. No. 4,949,959 discloses a barbell assist device utilizing a motor-driven yoke assembly. The yoke assembly provides cables that extend around sheaves and downwardly from each end of the housing to support a barbell over a weight bench. U.S. Pat. No. 5,048,826 discloses a device utilizing a winch assembly to retract and release cables supporting the barbell. U.S. Pat. No. 5,310,394 discloses a spotter system for weightlifters employing a pneumatic piston and cylinder. The cylinder provides lift assistance to the barbell through a lever arm, chain drive, pulley and cables.

None of the aforementioned devices provides independent support of both ends of the barbell, nor do they disclose use of the spotting equipment with dumbbells, a popular free-weight. Nor, do any of these references disclose a positive method of ensuring user-control of the weights before disengaging weight support.

U.S. Pat. No. 4,998,721 discloses a weightlifter's exercise apparatus utilizing two motor-assisted assemblies supporting a barbell through cables attached to each end. Although the two motors allow independent assist from each side, no positive method is disclosed to ensuring user-control of the weights before disengaging the supports.

U.S. application Ser. No. 09/201,434, disclosed by the applicant and hereby incorporated by reference, discloses a barbell safety spotting apparatus utilizing two rotary pawl clutches that engage respective chain assemblies connected to barbell support cables. Use of two rotary clutches allows independent motion of the support cables and therefore also the ends of the barbell. The rotary pawl clutches utilize solenoids which engage the clutch and J-shaped indentations which require removal of the weight bias caused by the free-weight before the clutch can disengage. When the clutches are engaged, the free-weights are supported, raised or lowered by a drive unit. When the clutches are disengaged, the cables allow independent and full-range motion of the free-weights.

U.S. Pat. No. 6,379,287, hereby incorporated as reference, makes a significant step forward in providing a weight-responsive engagement element which engages or disengages the free-weight cables to a weight-support assembly. The device also provides self-spotting of dumbbells and allows motion of free-weight ends independent of each other. U.S. Pat. No. 6, 293,892, hereby incorporated as reference, discloses a self-spotting apparatus for free-weights utilizing linear support assemblies. U.S. Pat. No. 6,537,182, hereby incorporated by reference, discloses use of weight-responsive engagement assemblies for support of free-weights.

Despite the improvements offered in the aforementioned patents, there remains a need for improved self-spotting free-weight apparatus which further improve the operation of the apparatus.

OBJECTS AND SUMMARY OF THE INVENTION

Therefore an object of the present invention is to provide a self-spotting apparatus for free-weights which is simple, rugged and low in cost.

A further object of the present invention is to provide a self-spotting apparatus for free-weights which provides weight-support assemblies capable of raising, lowering and statically supporting the full weight of the free-weights.

A further object of the present invention is to provide a self-spotting apparatus for free-weights which provides immediate transfer of weight to the support assemblies upon release of the free-weights by the user.

A further object of the present invention is to provide a self-spotting apparatus for free-weights which utilizes a weight-responsive assembly requiring the user to support substantially the full weight of the free-weights before disengagement from the support assemblies.

A further object of the present invention is to provide a self-spotting apparatus for free-weights which provides two support assemblies for support of the barbells from both ends an well as separate and independent support for two dumbbells.

A further object of the present invention is to provide a self-spotting apparatus for free-weights in which disengagement of the support cables from the support assemblies allows independent motion of the support cables.

A further object of the present invention is to provide a self-spotting apparatus for free-weights which provides "fail-safe" electrical features to provide support of the free-weights upon loss of electrical power to the apparatus or to the electrical components.

A further object of the present invention is to provide weight-support assemblies comprising vertical columns having vertically-spaced holes for engagement by pawls of weight-responsive engagement assemblies.

A further object of the present invention is to provide a cable attachment assembly which provides mechanical connection between the supporting cables of the apparatus and the free-weights, and "connector-less" electrical connection between grip sensors on the bar of the free-weight and a support cable.

A further object of the present invention is to provide an auxiliary stop to limit the downward motion of the free-weights.

Still another object of the present invention is to provide auxiliary stops which can be adjusted by manual or remote electrical means.

Yet another object of the present invention is to provide a control unit which requires actuation of both handgrips of a barbell for disengagement from the weight support assemblies, yet allows independent operation by a single handgrip with dumbbells.

The free-weight spotting apparatus of the present invention comprises two weight-support assemblies attached to a support stand. Each of two cable assemblies provides a connection between a free-weight and the respective support assembly through a weight-responsive engagement block constrained to reciprocating linear movement by a linear guide.

The weight-support assemblies provide static support to the free-weight when the weight-responsive engagement blocks are engaged to the respective support assemblies. The user must support the substantial weight of the free-weights in order to unlock and disengage the weight-responsive engagement blocks from the respective weight-support assemblies.

In the preferred embodiments, the weight-support assemblies are continuous chain loops supported vertically in the support stand. The weight-responsive engagement blocks comprise an engagement element such as a pawl which lock-engages the respective chain links in the weight-support direction. Also in the preferred embodiments, the pawls are biased continuously toward engagement by spring pressure and biased away from engagement by solenoids energized by pressure-sensitive switches disposed on the free-weight assembly. Lifting or support of the substantial weight of the free-weight by the user unlocks the pawls from the respective chain links and allows the bias force of the engaged solenoid to overcome the spring direction bias to disengage the pawl of the engagement block from the respective chain loops.

Once the blocks have been disengaged from the chain loops, the blocks reciprocate along the linear guides in response to raising and lowering of the free-weights by the user. When the blocks are both disengaged, free and independent vertical motion of both cables provides true "free-weight" exercise.

Upon de-energizing the solenoids, as would occur by release of a pressure-sensitive switch or touch switch on the free-weight by the user, the spring bias immediately engages the pawls of the blocks in links of the respective weight support assemblies. Engagement is positive and independent of electrical power.

In the preferred embodiments, the chain loops are supported vertically by lower drive sprockets and upper idler sprockets. A brake motor drives the chain loops through a reducer, providing power raising and lowering of the free-weights when the engagement blocks are engaged to the chain loops. A direction switch located on the support stand energizes the respective forward or reverse windings of the motor through a controller located in the stand. A foot switch provides override to the raise direction of the brake motor. When de-energized, the brake motor provides the static support of the free-weight through the respective drive sprockets, chain loops, block and cable assembly.

Each cable assembly in the preferred embodiment is supported by at least one sheave in the upper portion of the stand between the free-weight and the engagement block. The engagement block acts as a counter-weight maintaining minimum tension on the cable assemblies and aiding disengagement of the pawls when the solenoids are energized. The counterweight force of the engagement blocks biases the blocks in a direction opposite of the lock-engage direction bias of the free-weights.

The preferred embodiments provide two cables arranged in parallel fashion for each cable assembly attaching the free-weights to the respective blocks. Both cables of each cable assembly are sized to carry the full design load of the apparatus. One of the cables of each cable assembly is slightly longer than the other cable in the pair so that in normal operation, only one cable carries the free-weight load. Should cable breakage occur on the tensioned cable, the second cable of the cable assembly will provide full support of the free-weight.

The preferred embodiments also provide pivoting support booms with sheaves at each end for supporting the respective cable assemblies. The outer ends of the support booms adjust to the desired spacing to allow barbell and dumbbell use.

Safety features of the preferred embodiments include dual chain loops including dual drive and idler sprockets for each support assembly, dual engagement pawls, engagement springs and solenoids on each engagement block, and dual, series-connected pressure-sensitive switches on the free-weight assembly such as a barbell. In this manner, neither failure of any one of the dual components, nor power failure to the apparatus will result in the loss of support for the free-weight.

An alternative embodiment utilizes a ratchet bar fixed vertically in the support stand for each of the weight-support assemblies. An engagement block riding on vertical guides comprises a pawl or latch plate which engages teeth of the ratchet bar. Cable assemblies connected each end of a free-weight to the engagement blocks and are supported by cable sheaves on the upper portion of the support stand. In still other embodiments, the linear guide and support assembly are integral components, guiding and engaging the engagement blocks.

Still another embodiment utilizes a vertical column attached to the frame with vertically-spaced holes. The column acts as a weight-support assembly engaged by a weight-responsive engagement assembly comprising a pawl engageable with the holes of the column. A tubular guide of the weight-responsive engagement assembly surrounds and slideably engages the column to restrain motion of the weight-responsive engagement assembly to vertical motion along the column. The pawl comprises a non-inward tapered portion on the upper body to provide the weight-responsive disengagement feature of the apparatus and an inward tapered portion on the head portion of the pawl to improve engagement reliability.

The apparatus comprises a cable attachment assembly which provides both mechanical connection between the support cables of the apparatus and the bar of the free-weight assembly, and electrical connection between grip sensors on the bar and the support cable. Mechanical connection is made through a center collar having a journal for engagement with the bar of the free-weight assembly. The center collar comprises a mechanical cable connector for fastening one or more support cables to the center collar. The journal of the center collar allows rotation of the bar with respect to the center collar.

Electrical connection from the grip sensors is made through an inner collar fixed to the bar having a sliding electrical contact such as a brush in electrical connection with a grip sensor positioned on the bar. The brush is in electrical contact with a second sliding electrical contact such as a slip ring on the center collar. The slip ring of the center collar is electrically connected to one of the support cables. The brush and slip ring allow electrical contact from the touch sensor to the support cable despite rotation of the bar with respect to the support (center) collar. A groove in the journal of the center collar engages a tab in the bar to limit rotation of the bar so that the hands of the user remain in contact with the grip sensor.

Still another embodiment of the present invention utilizes an auxiliary stop on each column of the weight support assembly. The auxiliary stop of the preferred embodiment has a cross section having a sliding fit with the support column and a pin or pawl engageable with the holes of the column. A spring biases the pin inwardly to engage one of the holes of the column. With the pin engaged, the auxiliary stop, positioned above the weight-responsive engagement assembly prevents upward movement of the weight-responsive engagement assembly and therefore defines the lowest position which the free-weights may be positioned.

The auxiliary stops may be re-positioned by actuation of a disengagement lever, withdrawing the pin from the hole in the support column and allowing repositioning of the stop. In an alternative embodiment, the pin of the auxiliary stop is withdrawn by energizing a solenoid on the auxiliary stop. The solenoids of both auxiliary stops are energized by a foot switch or knee switch.

An electrical control unit having a mode switch may be used to switch between a control logic requiring two grip actuators or switches to energize the solenoids of the weight-responsive engagement assemblies (for use with barbells), or requiring actuation of only one grip actuator for independent energizing of a solenoid of one of the weight-responsive engagement solenoids for use with dumbbells.

BRIEF DESCRIPTION OF THE DRAWINGS

These and other features, aspects and advantages of the present invention will become better understood with regard to the following description, appended claims and accompanying drawings where:

FIG. 14A is a side elevation drawing of the pawl assembly of FIG. 13;

FIG. 14B is a back end view of the pawl assembly of FIG. 13;

FIG. 15A is a side elevation drawing of the pawl of FIG. 13;

FIG. 15B is an end view of the pawl of FIG. 13 looking at the pawl head end;

FIG. 15C is an end view of an alternative embodiment of a pawl of the present invention;

DESCRIPTION OF THE PREFERRED EMBODIMENTS

The following is a description of the preferred embodiments of a barbell spotting apparatus which provides a user with unconstrained "free weight" use, yet allows power positioning and "dead-man" safe-locking features.

Figure 1:
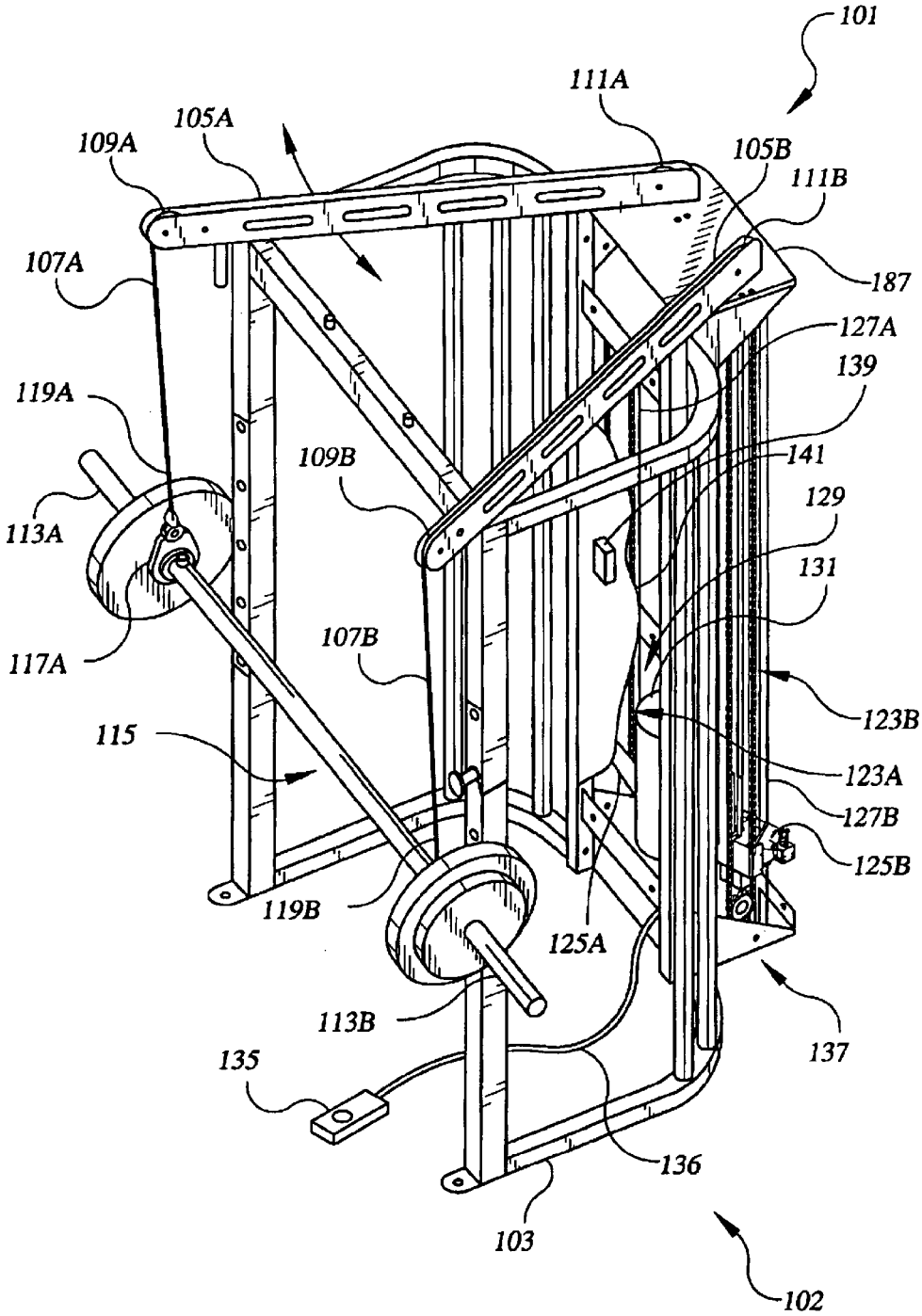
FIG. 1 is a right front-quarter isometric drawing of an embodiment of the self-spotting apparatus for free-weights showing the support stand comprising a frame and two pivoting support booms, right and left cable assemblies supported by sheaves at each end of the support booms attached to a barbell and connected to respective weight-responsive engagement blocks, the blocks engaging respective weight-support chain loops driven by a positioner.

FIG. 1 is right front-quarter isometric drawing of embodiment 101 of the barbell spotting apparatus comprising a support stand 102 having a frame 103, tower enclosure 137 and pivoting weight-support booms 105A and 105B. Cable assemblies 107A and 107B, supported by sheaves 109A and 111A of boom 105A and sheaves 109B and 111B of boom 105B are attached to barbell ends 113A and 113B of a free-weight assembly such as barbell 115. Releasable attachments such as cable attachment assemblies 117A and 117B (shown most clearly in FIG. 7) connect respective cable assembly end portions 119A and 119B to barbell ends 113A and 113B.

Opposite cable assembly end portions 121A and 121B (121B shown best in FIG. 6) are connected to respective weight-support assemblies such as chain assemblies 123A and 123B through chain engagement blocks 125A and 125B. Engagement blocks 125A and 125B reciprocate vertically, constrained laterally by linear guides 127A and 127B and engage the respective chain assemblies to support barbell 115. Engagement blocks 125A and 125B allow independent free-weight movement of barbell 115 when blocks 125A and 125B are disengaged from respective chain assemblies 123A and 123B. Apparatus left side components such as chain assembly 123A, block 125A and guide 127A function the same as right side components such as chain assembly 123B, block 125B, and guide 127B.

Positioner 129 comprises a motor/reducer 131 and drive sprockets (shown best in FIG. 3) which drive and support the lower portions of chain assemblies 123A and 123B. Positioner 129 positions blocks 125A and 125B in the desired vertical position when blocks 125A and 125B are engaged to respective chain assemblies 123A and 123B. Block 125A and 125B positions determine the position of barbell 115 by linkage through cable assemblies 107A and 107B.

Figure 10:
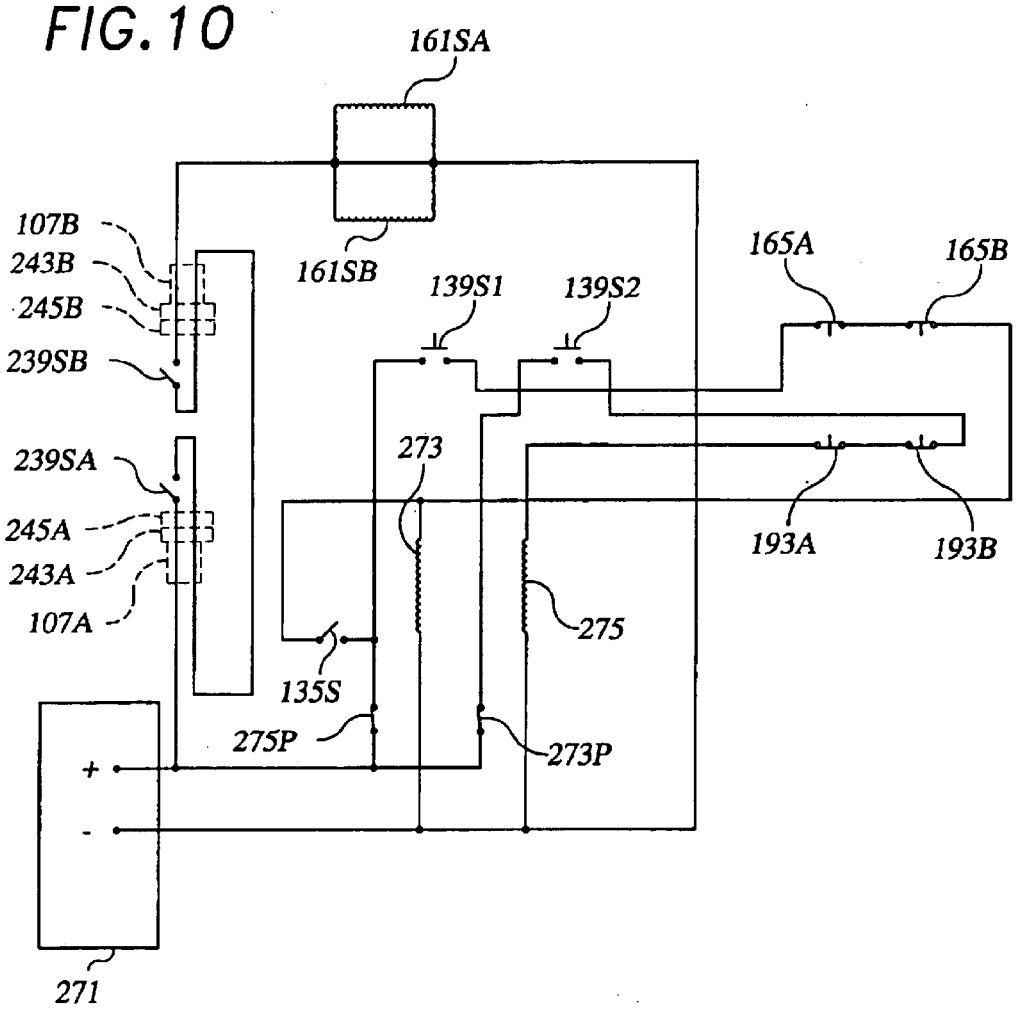
FIG. 10 is an electrical schematic diagram of the electrical controls of the apparatus of FIG. 1 including barbell pressure-sensitive switches, positioner switches, floor switch, engagement block solenoid groups and motor winding relays.

Foot switch 135, connected by cable 136 to the controller circuitry of FIG. 10, energizes positioner 129 to raise barbell 115 when activated. Up/down momentary position switches 139, mounted on tower enclosure front panel 141 (shown in partial cutaway) energizes positioner 129 in a direction to raise and lower barbell 115.

Figure 2:
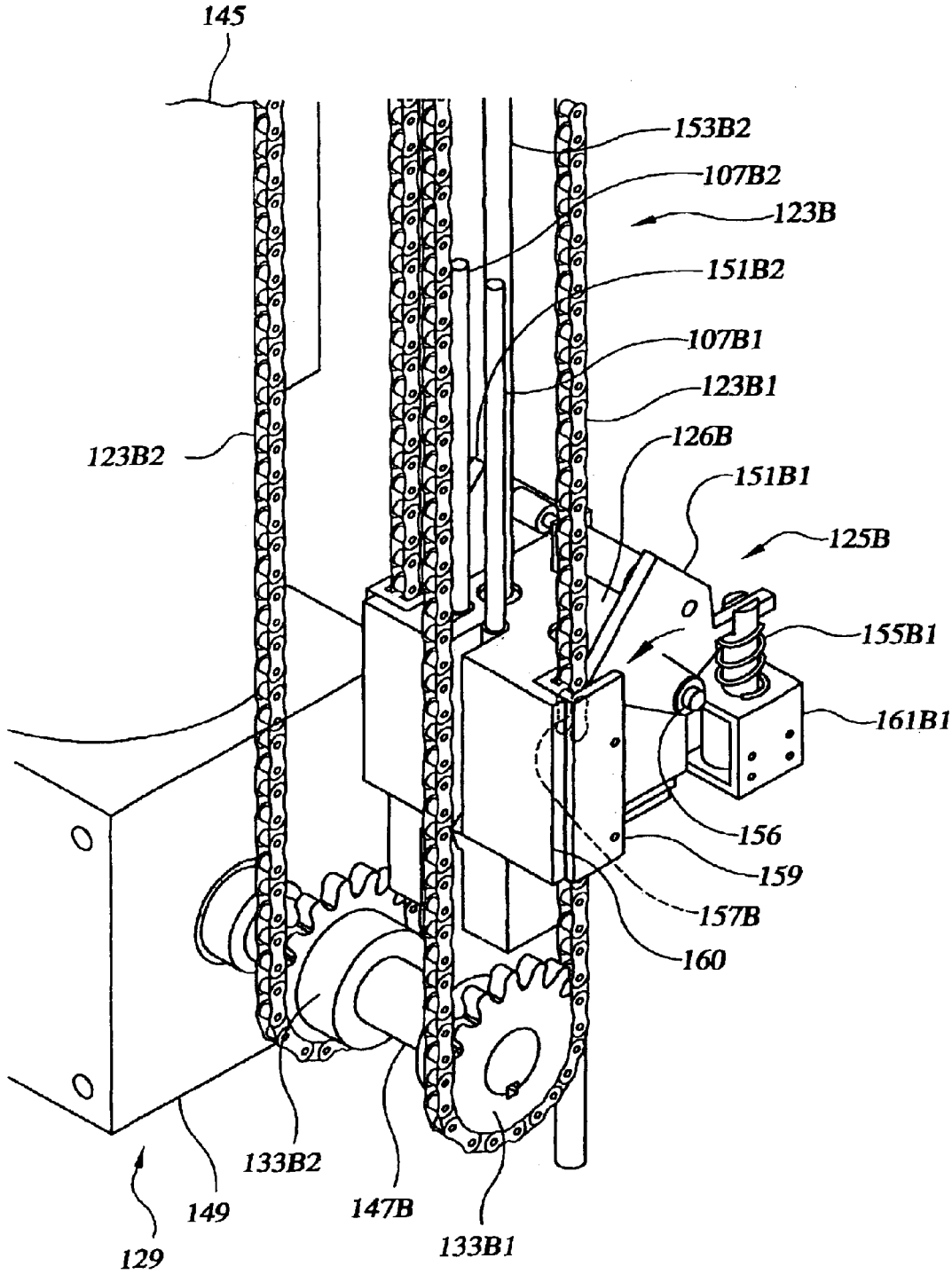
FIG. 2 is a right front-quarter isometric detail drawing of the right engagement block engaging the right weight-support assembly consisting of two continuous chain loops driven and supported by bottom drive sprockets mounted on the gear reducer shaft.

FIG. 2 is a right front-quarter isometric detail drawing showing the lower portion of right side chain assembly 123B, positioner 129, and chain engagement block 125B. The corresponding left side components (chain assembly 123A and right chain engagement block 125A) are similar and perform a similar function. Brake motor 145 rotates right side lower chain sprockets 133B1 and 133B2 of right drive shaft 147B through right angle reducer 149. Sprockets 133B1 and 133B2 are keyed to shaft 147B to lock the sprockets rotationally to shaft 147B.

Right side chain assembly 123B comprises two continuous chain loops, 123B1 and 123B2, supported by upper and lower sprockets. Upper idler sprocket (185B1 of FIG. 5) and lower sprocket 133B1 support chain loop 123B1 in a vertical orientation. Sprocket 133B1 drives loop 123B1 in either direction, depending on the rotational direction of drive sprocket 133B1. In a similar manner, upper idler sprocket (185B2 of FIG. 5) and lower sprocket 133B2 support chain loop 123B2 in a vertical orientation, with drive sprocket 133B2 positioning chain loop 123B2 when rotated by brake motor 145 through reducer 149.

Pawls 151B1 and 151B2 of chain engagement block 125B engage and lock block 125B to chain loops 123B1 and 123B2. In this manner, positioner 129 positions block 125B in the desired vertical position through rotation of lower drive sprockets 133B1 and 133B2. Linear guide rods 153B1 and 153B2 (shown best in FIG. 3), provide a slide fit with linear guide follower apertures 154B1 and 154B2 in body 126B of block 125B and constrain block 125B to linear, vertical motion. The linear guides ensure that pawls 151B1 and 151B2 of engagement block 125B maintain an engagable position with respect to the respective chain loops. Vertical motion of block 125B positions end 113B of barbell 115 of FIG. 1 to the desired position through cable assembly 107B and sheaves 109B and 111B.

Compression spring 155B1, compressed in the position shown, provides engagement force on pawl 151B1 to bias rotation of the pawl in the engagement direction (counterclockwise about pivot pin 156) and engages the tip of pawl 151B1 in link 157B (shown in phantom lines) of chain loop 123B1. The weight of barbell 115 produces an upward force on block 125B though tension in cable assembly 107, and provides a supplemental or locking engagement force by attempting to further rotate pawl 151B1 in the engagement direction. Since support channel 159, supported by backing plate 160 prevents forward (away from pawl 151B1) movement of chain link 157, pawl 151B1 engages link 157 harder with increasing downward force on barbell 115.

Figure 4:
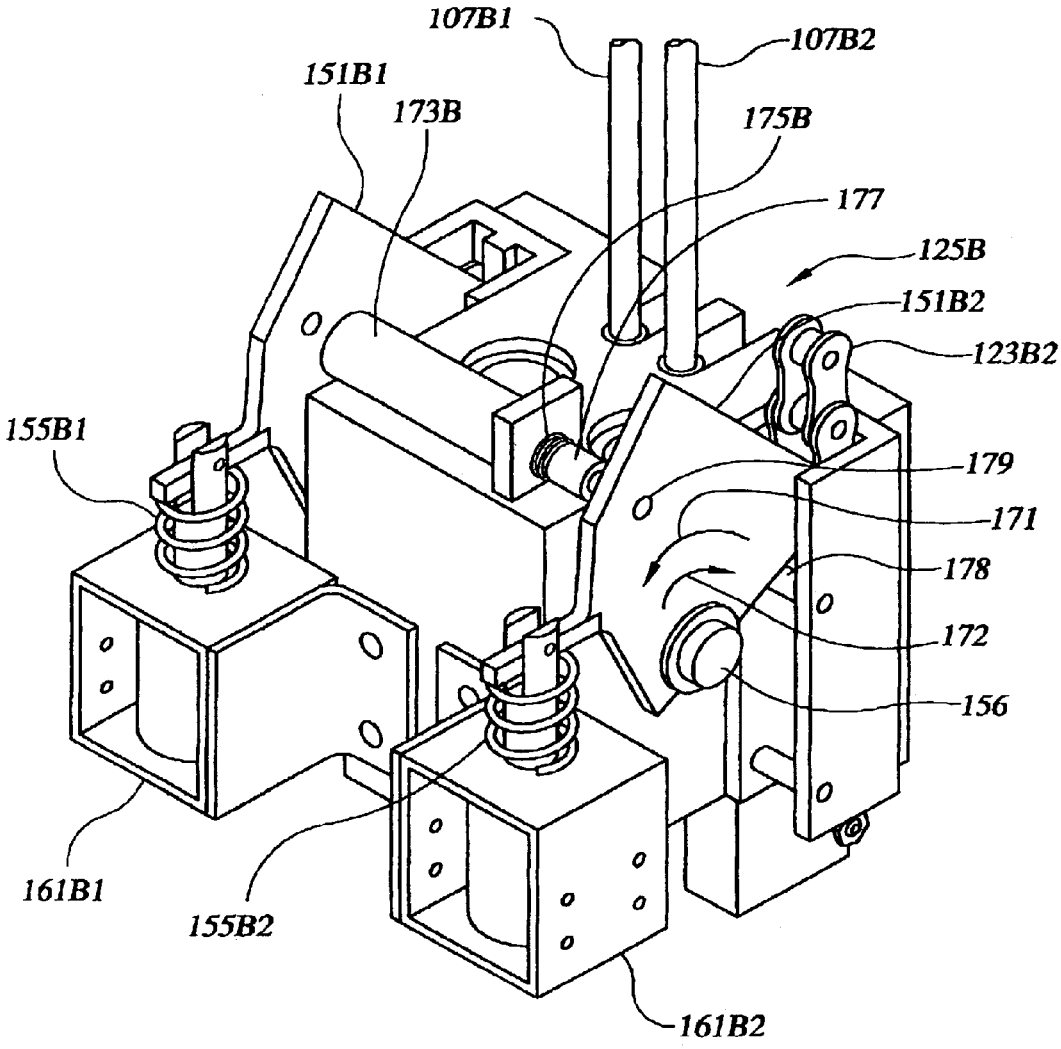
FIG. 4 is a left rear-quarter isometric detail of the right side engagement block showing two engagement pawls, one shown engaging a link of one of the right chain loops.

Counterclockwise or locking direction engagement rotation of pawl 151B1 stops when pawl 151B1 is pushed back fully against support channel 159, or optionally, contacts a mechanical stop (178 of FIG. 4). In the preferred embodiments, support channel 159 is made of a high compression-strength plastic material such as ultra-high density molecular weight polyethylene or polyamide to support the respective chain loops and provide a low friction bearing surface. In the preferred embodiments, block 125B is made of steel and pawls 151B1 and 151B2 are made of high strength tool steel.

Energizing solenoid 161B1 provides a disengagement force and biasing pawl 151B1 in a disengagement (clockwise) direction about pivot pin 156. Although this disengagement force is greater than the engagement force provided by spring 155B, it is less than that needed to overcome the locking engagement force resulting from the weight of barbell 115 acting through cable assembly 107.

In a preferred embodiment, disengagement of pawl 151B from link 157 of chain loop 123B1 requires countering of much or most of the weight of barbell 115 acting on block 125B. In the most preferred embodiments, disengagement of pawl 151B from link 157 of chain loop 123B1 requires countering of all of the weight of barbell 115. Countering of weight from barbell 115 may be accomplished by lifting barbell 115 vertically against gravity, thereby removing tension in cable assembly 107B.

In this manner, block 105B acts as a weight-responsive engagement assembly, allowing disengagement of the free-weight assembly from the chain loops when a user supports all or a substantial portion of the downward force of the free-weight assembly, yet fully engages the chain loops when the full downward force of the free-weight is transferred to it.

Selection of solenoid 161B retraction force, spring 155B force, or pawl 151B1 dimensions and pivot location provide a means to select the counter force required by the user lifting the barbell to disengage block 125B from chain loop 123B1. Selection of these parameters may also require some downward motion of the block (requiring the user to fully support the free weight, less the counterweight force of the block) in order for the counterweight effect of block 125B to descend, allowing pawl 151B1 to fully clear link 157B and retract to the disengaged position.

Figure 3:
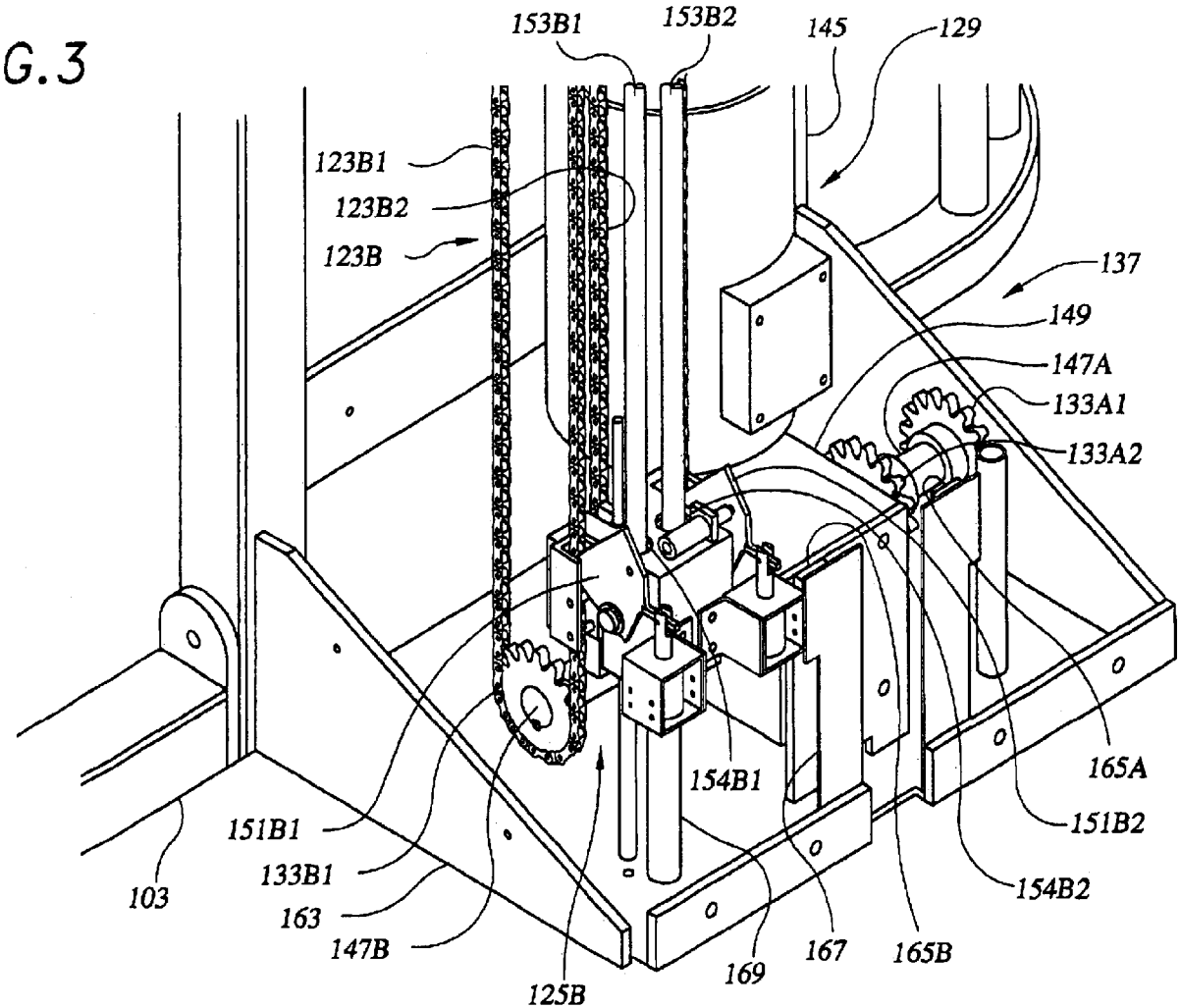
FIG. 3 is a right rear-quarter isometric detail of the lower tower portion of the apparatus showing the lower bracket of the support stand, positioner brake motor and reducer, and the right side engagement block and chain loops.

FIG. 3 is a right rear-quarter isometric drawing of the lower portion of tower enclosure 137 with cover panels removed. Lower bracket 163, fixed to frame 103, supports reducer 149 and brake motor 145. Fasteners (not shown) attach reducer 149 to bottom bracket 163. Shafts 147A and 147B of reducer 149 support and rotate lower drive sprockets 133A1, 133A2, 133B1 and 133B2 as discussed previously. In the preferred embodiment, shafts 147A and 147B are end portions of the same shaft extending through right angle gear reducer 149.

Guide rods 153B1 and 153B2 provide lateral support to block 125B and allow vertical movement of the block. Guide rod bottom fasteners (not shown) attach the bottom of guide rods 153B1 and 153B2 to bottom bracket 163. Chain loops 123B1 and 123B2 provide vertical support and vertical positioning of block 125B when engaged to pawls 151B1 and 151B2 of block 125B. In the preferred embodiments, guide rods 153B1 and 153B2 are steel pipe of circular or rectangular cross-section. In other embodiments, one or more structural shapes such as I-shapes or T-shapes may be used.

Upper limit switch 165B, attached to bracket 167 stops motor 145 when block 125B approaches mechanical stop 169, corresponding to the upper limit of barbell 115. Mechanical stop 169 prevents over-travel of block 125A should limit switch 165B fail. Left side chain assembly 123A, block 125A and guide rods 151A1 and 151A2 are not shown for clarity, but perform a similar function. Likewise, springs 155B1 and 155B2 are omitted from block 125B in this figure for clarity.

FIG. 4 is a right rear-quarter isometric drawing of engagement block 125B showing pawls 151B1 and 151B2 pivoted about pivot pins 156. Solenoids 161B1 and 161B2 provide a "pull" disengagement force when energized to bias the pawls in the disengagement direction of arrow 171. Springs 155B1 and 155B2, provide a constant "push" engagement force to bias the pawls in the engagement direction of arrow 172.

Solenoid 173B de-energizes with solenoids 161B1 and 161B2. Spring 175B of solenoid 173B biases lock pin 177 of solenoid 173B towards pawl 151B2 to engage and lock in hole 179 of pawl 151B2 when pawl 151B2 is engaged with chain loop 123B2. When engaged, lock pin 177 prevents pawl 151B2 from rotating in direction 171 and disengaging from chain loop 123B2. Lock pin engagement of pawl 151B2 provides positive engagement of pawl 151B2 with chain loop 123B2 during adjustment of chain loop 123B2 position regardless of tension on cables 107B1 and 107B2. This feature also prevents block 125B (which acts as a counterweight, maintaining minimum tension in cable assembly 107B) from disengaging and falling if there is no free-weight on the cables, for example if barbell 115 is removed at cable attachments 117A and 117B.

Energizing solenoid 173B (which in the preferred embodiments occurs with energizing solenoids 161B1 and 161B2) overcomes the engagement bias of spring 175B and disengages lock pin 177 from hole 179 in pawl 151B2, allowing disengagement of pawl 151B2.

Figure 5:
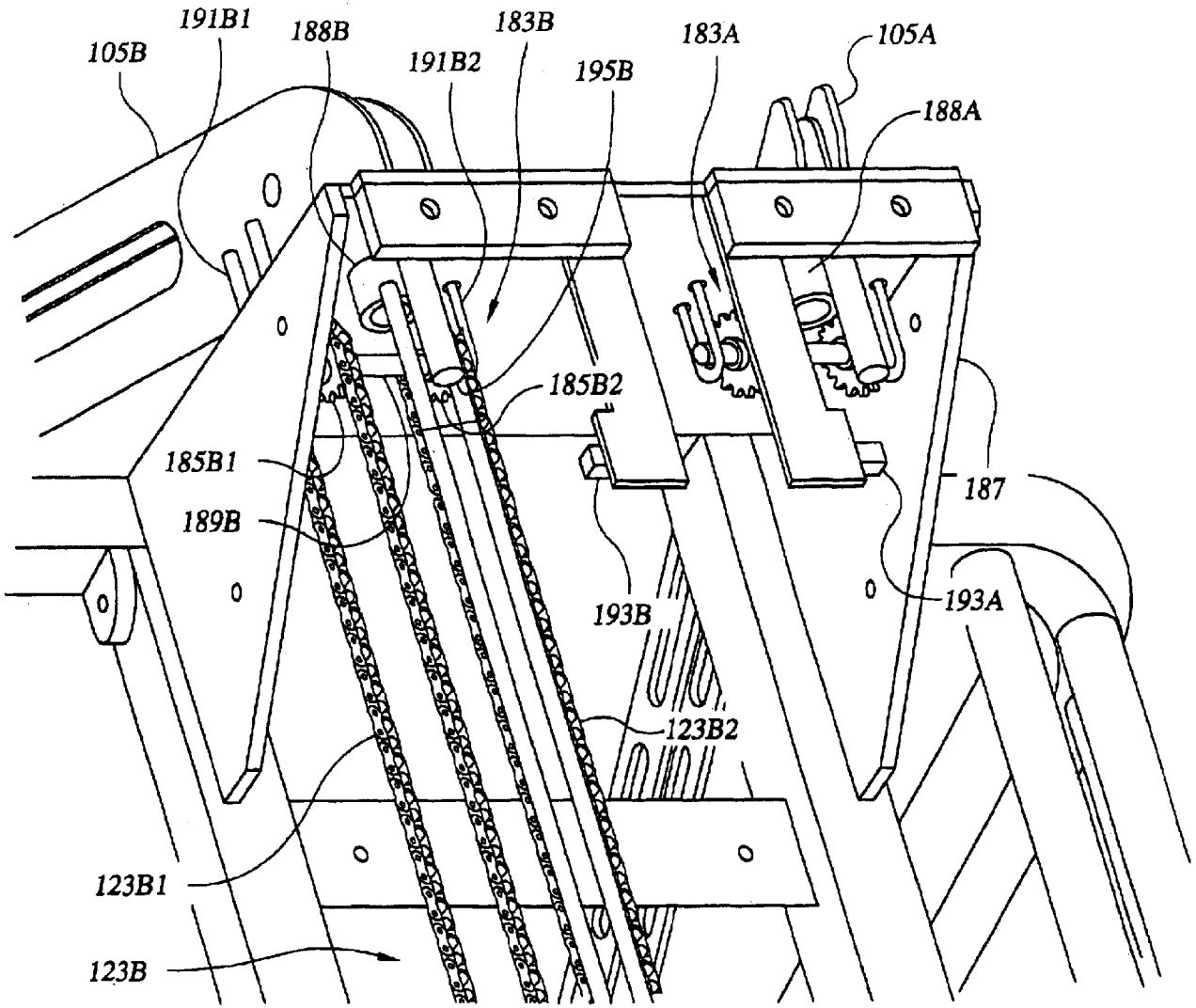
FIG. 5 is a right rear-quarter isometric looking upwards at the idler sprockets and shafts supporting the upper portions of the chain assemblies.

FIG. 5 is a right rear-quarter isometric drawing of top bracket 187 supporting upper idler sprocket assemblies 183A and 183B. Upper sprockets 185B1 and 185B2 engage and support the top of respective chain loops 123B1 and 123B2 of chain assembly 123B. Upper sprockets 185B1 and 185B2 are supported from top bracket 187 via idler shaft 189B and idler shaft U-bolt supports 191B1 and 191B2. Supports 191B1 and 191B2 are supported from top bracket 187 by adjustment bolts and springs (not shown) to provide chain tension adjustment.

Limit switch 193B provides switching to motor controller circuitry shown in FIG. 10 when bock 125B approaches the top portion of tower enclosure 137. Mechanical stop 195B provides a positive stop to prevent block 125B from damaging and disengaging from upper chain assembly 123B and sprocket assembly 183B. Chain upper sprocket assembly 183A function and operation is similar to assembly 183B. Chain loop 123A and the respective cable assemblies are omitted for clarity of the drawing.

Fasteners (not shown) fix guide rods 153A1, 153A2, 153B1 and 153B2 to top bracket 187. Pivot bushings 188A and 188B pivotally attach respective support booms 105A and 105B to top bracket 187.

Figure 6:
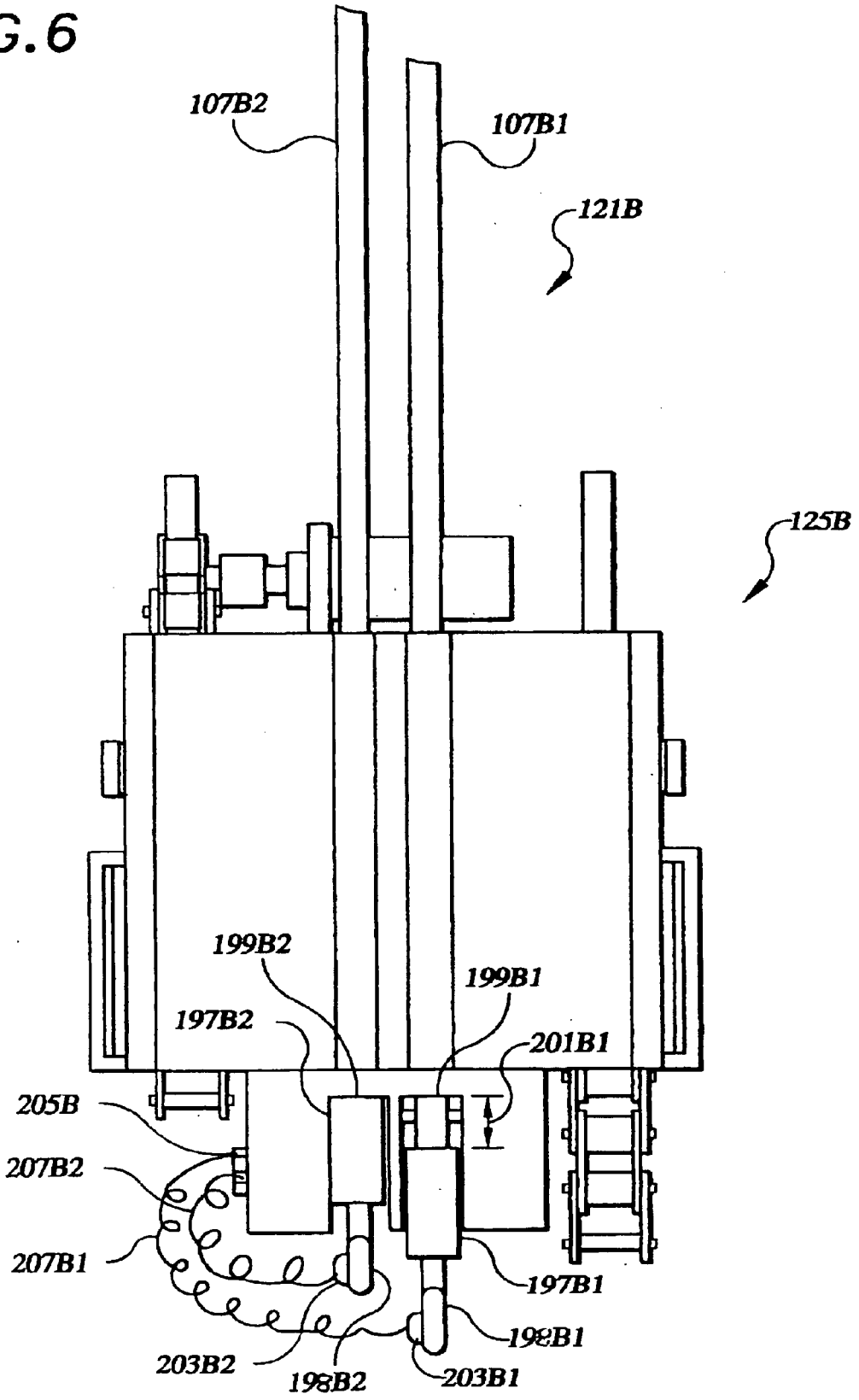
FIG. 6 is a rear elevation drawing of the right side engagement block showing attachment of the two cables of the right cable assembly.

FIG. 6 is a front elevation drawing of block 125B showing the attachment method of cables 107B1 and 107B2 of cable assembly end portion 121B. Crimp blocks 197B1 and 197B2 crimp the ends of the respective cable loops 198B1 and 198B2 to the respective cables. Cable 107B1 is made slightly longer than cable 107B2 so that tension on cable assembly 107B from the weight of barbell 115 seats crimp block 197B2 against seat 199B2 of block 125B. Due to the longer length of cable 107B1, crimp block 197B1 does not contact seat 199B1, but remains in loose tension due to spacing 201B1. Should cable 107B2 fail under tension, the resulting tension in cable 107B1 of cable assembly 107B will move crimp block 197B1 against seat 199B1, and provide restraining force on further movement of cable 107B1.

Since both cables 107B1 and 107B2 are sized to provide the full design break strength required of the apparatus, the dual cable design provides a measure of safety since only one cable is under tension in normal operation. Should the cable under tension fail, a previously non-tensioned cable will provide full backup. However, breakage of a cable will interrupt control current flow in one of the cable assemblies of FIG. 10, locking the blocks to the chain loops and preventing normal use of the equipment. In the preferred embodiments, cables 107B1 and 107B2 are aircraft grade steel cables to provide high strength.

Cables 107B1 and 107B2 provide electrical connections for block 123A and 123B solenoid actuation as shown in the schematic diagram of FIG. 10. Flexible wires 207B1 and 207B2 connect loops 198B1 and 198B2 of cables 107B1 and 107B2 to terminal block 205. The electrical connections 203B1 and 203B2, which may be solder connections or crimp connections, provide a secure electrical connection between cable loops 198B1 and 198B2 and wires 207B1 and 207B2. Seats 199B1 and 199B2 are electrically insulated from each other, for example, by one or both seats made of an electrically insulative material. Construction and operation of block 121A and cable assembly end portion 119A is similar.

Figure 7:
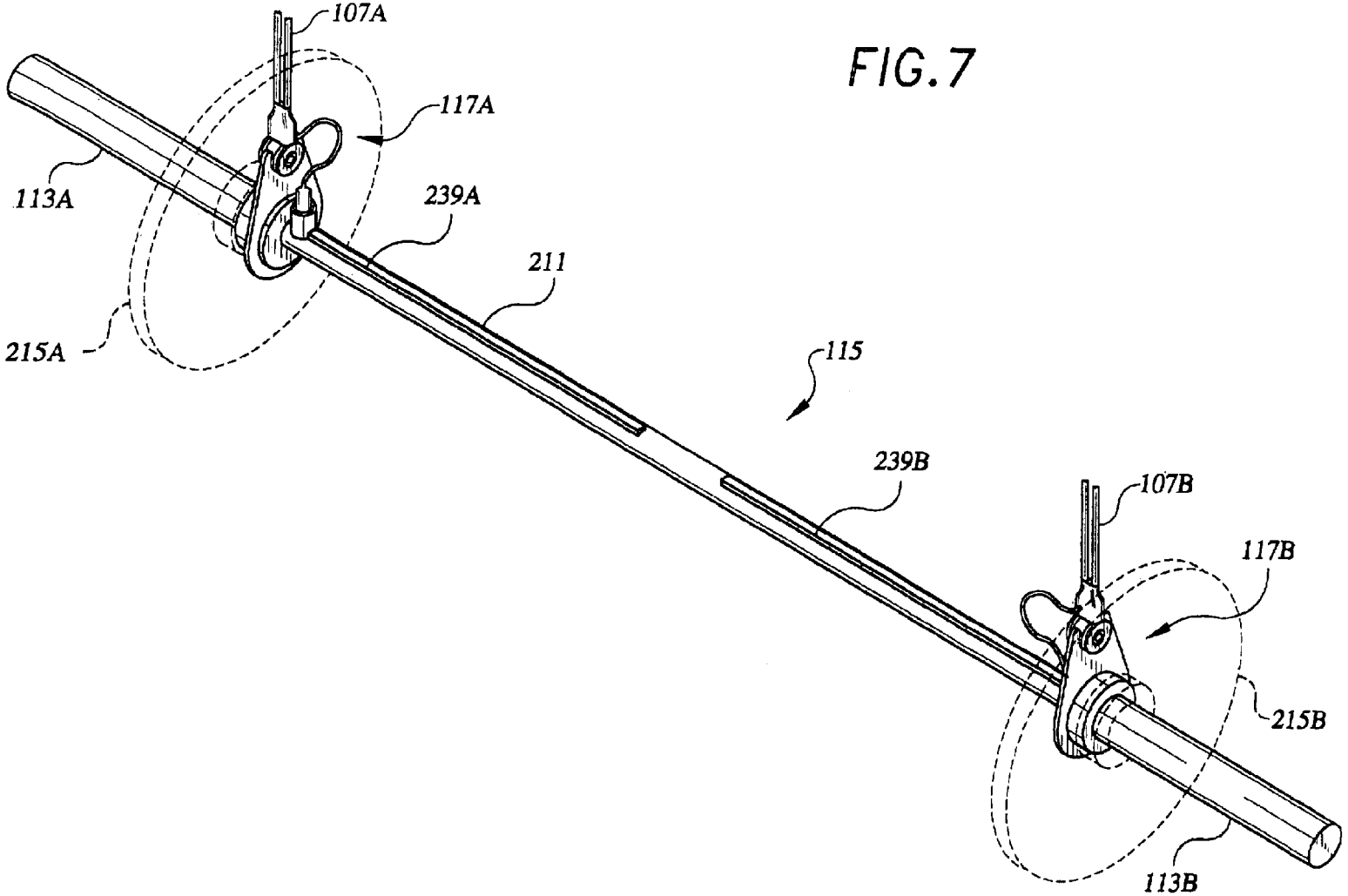
FIG. 7 is a right front-quarter isometric drawing of the barbell showing right and left pressure-sensitive switches, cable attachment assemblies, and right and left cable assemblies.

FIG. 7 is a right front-quarter isometric of barbell 115 of the present invention comprising cable attachment assemblies 117A and 117B connecting respective cable assemblies 107A and 107B to bar portion 211. Barbell ends 113A and 113B provide bar ends dimensioned for attachment of standard free-weights 215A and 215B, shown in phantom lines.

Figure 8:
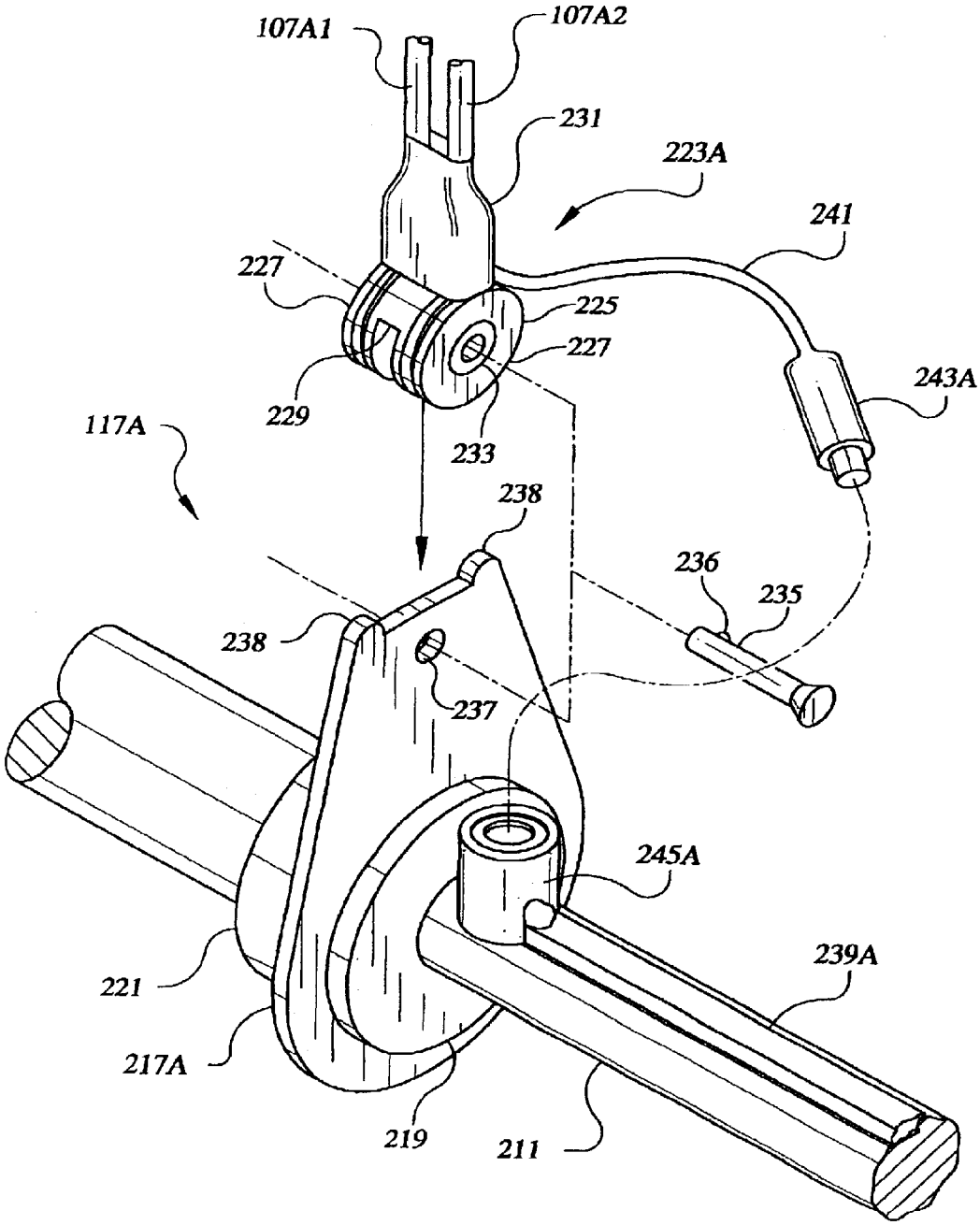
FIG. 8 is a isometric detail of the left cable attachment assembly of the barbell, showing mechanical and electrical connections to the barbell.

FIG. 8 is an isometric detail of cable attachment assembly 117A showing bar attachment flange 217A fixed to bar 211 by bushings 219 and 221. Cable attachment fitting 223A comprises slotted bushing 225 having two cable loop disc portions 227 and alignment slot 229. Cables 107A1 and 107A2 are looped around slots in the respective disc portions of bushing 225 and crimped to the cable by cable crimps (not shown). In the preferred embodiments, slotted bushing 225 is made of an electrically insulative material such as high strength plastic. Loop bushings 233, made of metal and located in each disc portion 227, provide strength for transmitting force from the respective cables to pin 235 when inserted through bushing 225 and hole 237 of bar attachment flange 217A. Slot 229 and bushing alignment guides 238 allow quick alignment of loop bushings 233 and hole 237 to aid in insertion of pin 235. Spring detent 236 of pin 235 retains pin 235 in bushing 225 until pulled out by a user.

An actuator such as touch sensor or pressure-sensitive switch 239A, mounted on bar 211 by adhesives or mechanical fasteners, provides quick-reaction ability to lock barbell 115 to the respective chain assemblies of FIG. 1. Cables 107A1 and 107A2 provide the electrical connections to the engagement block solenoids through two-conductor cable connector 241, plug 243A and receptacle 245A mounted on bar 211. The conductors of cable connector 241 may be soldered or crimped to the respective cable loops (not shown). The operation and function of cable attachment assembly 107B and pressure-sensitive switch 239B of FIG. 7 is similar.

In embodiments utilizing pressure-sensitive switches as an actuator for the solenoids, the user must exert pressure on the switch, preferably mounted on the upper portion of bar 211, in order to actuate the switch. In other embodiments, a touch sensor is substituted for the pressure switches. Direct contact of the user's hand activates the touch sensor. In still other embodiments, a proximity sensor may be used.

Figure 9:
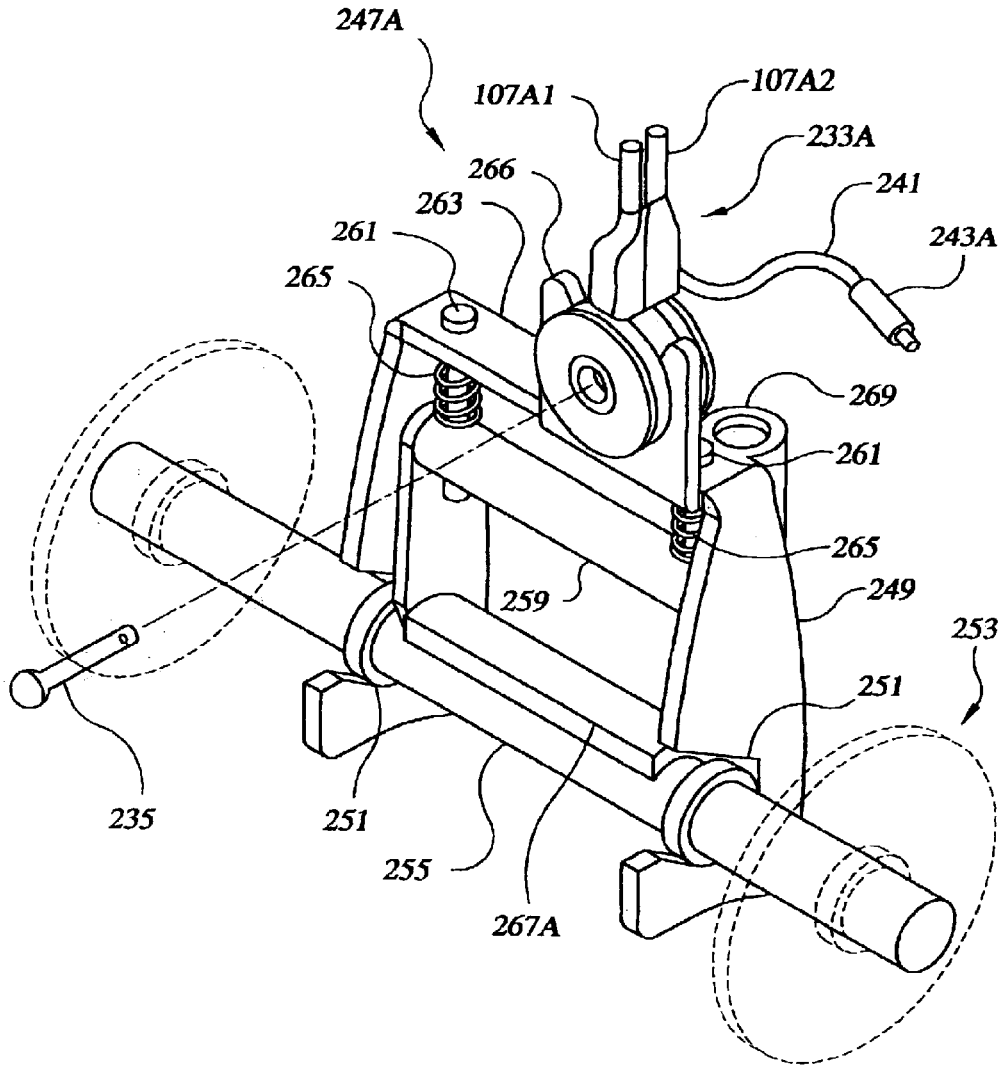
FIG. 9 is a right front-quarter isometric drawing of the left side dumbbell frame supporting a free-weight dumbbell showing the mechanical and electrical connections to the left side cable assembly.

FIG. 9 is an isometric drawing of dumbbell assembly 247A for use singly or in pairs instead of barbell 115. Dumbbell frame 249 comprises barbell slots 251 for insertion and retention of a standard free-weight dumbbell 253. In the preferred embodiments, slots 251 slope downward or are J-shaped to retain bar 255 of dumbbell 253. In this way, bar 253 must be lifted against gravity in order to remove the bar from frame 249. Sub-frame 259, supported from frame 249 by sliding pins 261 in holes of top frame bar 263, is biased against bar 255 by springs 265. Attachment flange 266, fixed to frame 249 by welding or fasteners, provides mechanical attachment of cable attachment fitting 233A to dumbbell assembly 247A similar to that of the barbell of FIG. 8.

Sub-frame 259 comprises a pressure-sensitive switch 267A, similar to that used on barbell 155, and connected to cables 107A1 and 107A2 through receptacle 269, plug 243A, and connector 241, similar to barbell 115 connections explained previously. A second dumbbell (not shown) may be connected to cable attachment fitting 233B in a similar manner.

FIG. 10 is a schematic diagram of one embodiment of the electrical controls for the barbell spotting apparatus. A nominal 24-volt D.C. power supply 271 supplies power to the respective positive and negative terminals. Plugs 243A and 243B of respective cable assemblies 107A and 107B connect to receptacles 245A and 245B of barbell 115. Solenoid coil 161SA of block 125A and solenoid coil 161SB of block 125B are energized when contact 239SA of pressure-sensitive switch 239A and contact 239SB of pressure-sensitive switch 239B of barbell 115 are both closed.

Solenoid coil 161SB of this figure represents all three coils of solenoids 161B1, 161B2, and 173B of block 125B connected in parallel. In a similar manner, solenoid coil 161SA of this figure represents all three coils of solenoids 161A1, 161A2, and 173A of block 125A connected in parallel. Gripping and squeezing of the upper portion of barbell 115 of FIG. 7 by the right and left hands of a user will close respective pressure-sensitive switch contacts and energize the solenoids. Opening of either pressure sensitive switch (as would occur upon release of the upper side of the barbell by either hand of the operator) will de-energize the solenoids, engaging the engagement blocks to the chain assemblies.

Figure 10A:
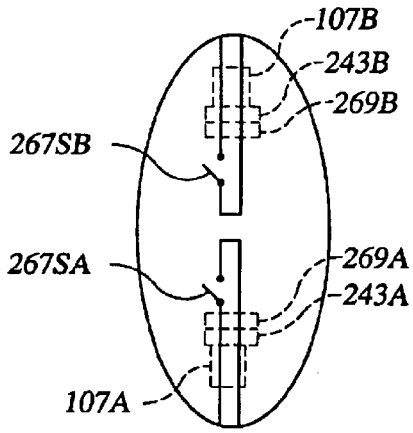
FIG. 10A is an electrical schematic diagram of the dumbbell electrical connections of the electrical controls of FIG. 10.

FIG. 10A shows pressure-sensitive contact connections when dumbbells are utilized with the apparatus. Plugs 243A and 243B of respective cable assemblies 107A and 107B connect to receptacles 269A and 269B of the dumbbells as illustrated in FIG. 9. In this case, release of either pressure-sensitive switch of the dumbbells de-energizes solenoids to both blocks 125A and 125B. In other embodiments, opening of either dumbbell switch de-energizes the solenoids of only the block supporting that dumbbell. This function could be made selective, for example, by a mode selection switch which places only the respective pressure-sensitive switch in series with the respective block solenoids when the "dumbbell" mode is selected.

"Up" relay 273 and "down" relay 275 provide power to the respective forward and reverse direction windings of brake motor 145 when energized. Normally-closed contact 275P of relay 275 and 273P of relay 273 provide protection from energizing both motor windings simultaneously. Activation of "up" contact 139S1 of positioner switch 139 (FIG. 1) energizes "up" relay 273 as long as neither upper limit switch 165A or 165B of FIG. 3 is opened by activation of the respective block approaching the mechanical limit. Likewise, activation of "down" contact 139S2 of positioner switch 139 energizes "down" relay 275 as long as neither lower limit switch 193A or 193B of FIG. 5 are opened.

In the preferred embodiments, closing foot switch contact 135S of foot switch 135 (FIG. 1) energizes "up" motor winding relay 273, regardless of position of the respective blocks.

Figure 11A:
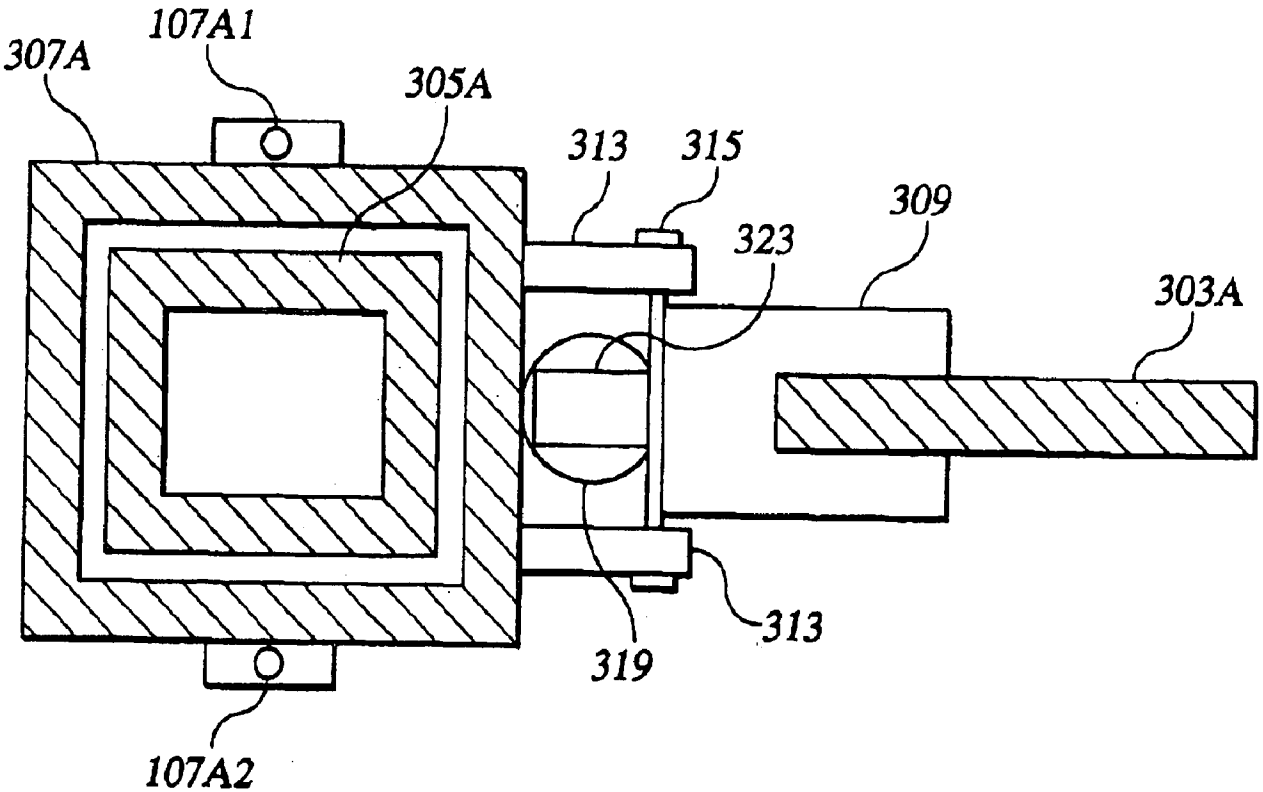
FIG. 11A is a top view and partial cross-section of an alternative embodiment of the present invention showing a weight-responsive engagement block riding on a vertical guide and engaging a vertical ratchet bar.
Figure 11B:
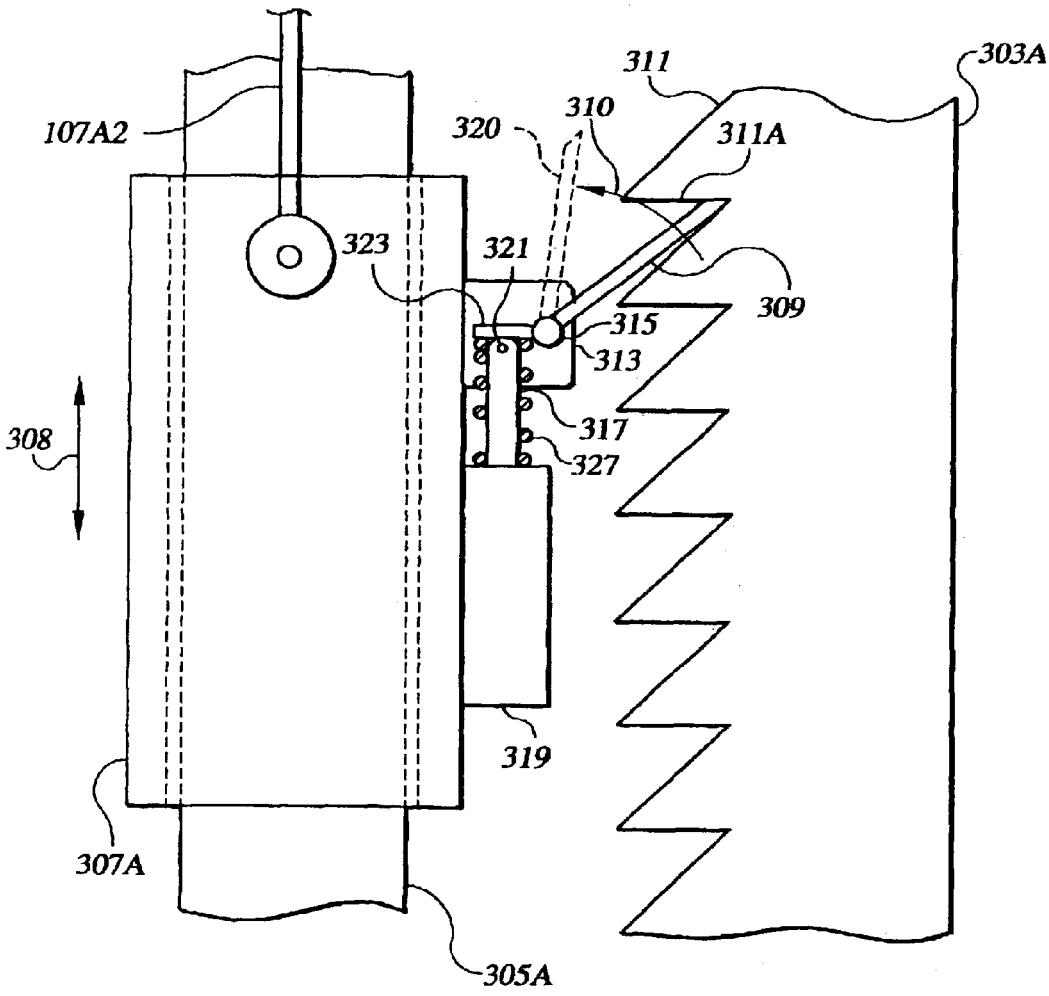
FIG. 11B is a side elevation drawing of the embodiment of FIG. 11A with one of the latch plate support brackets partially removed and the compression spring shown in cross-section for clarity.

FIGS. 11A and 11B are top and side elevation views, respectively, of an alternative embodiment of a self-spotting apparatus utilizing a fixed ratchet bar 303A substituted for each of the chain weight-support assemblies of the previous embodiment. Ratchet bar 303A and linear guide 305A are fixed to a support stand in a vertical orientation as shown in FIG. 11B. Linear guide 305A laterally constrains weight-responsive engagement block 307A and allows. lertical motion of block 307A as shown by arrow 308. Cables 107A1 and 107A2 connect the free-weight assembly to block 307A and may be supported by one or more sheaves from the support stand similar to the previous embodiment.

Latch plate support brackets 313 and pivot pin 315 support pawl or latch plate 309 from block 307A. Armature 317 of solenoid 319 pivots latch plate 309 about pivot pin 315. Pin 321 pivotally connects armature 317 to lever plate 323 of latch plate 309. Latch plate 309 pivots in the direction of arrow 310 from the engaged position with tooth 311 as shown in the figure to an unengaged position as shown in the phantom lines.

In the preferred embodiments, the latch plate length, pivot pin-to-tooth distance, and tooth bottom surface 311A slope are selected so that block 307A, biased in the upward direction by the weight of the free-weights and cables 107A1 and 107A2, does not move upward as latch plate 309 pivots towards the unlatched direction of arrow 310. In the most preferred embodiments, block 307A must move downwards (against the free-weight bias) in order for latch plate 309 to move in direction 310.

Compression spring 327 biases latch plate 309 in the latched position. Solenoid 319 biases latch plate 309 toward the unlatched position 320 when energized. In the preferred embodiment, energized solenoid bias is greater than spring 327 bias on latch plate 309. However, solenoid 319 unlatching bias is not sufficient to overcome the combination of frictional forces of the end of latch plate 309 on tooth surface 311A and the placement of latch components requiring movement of block 307A downward in order to rotate latch plate 309 in direction 310. Therefore, unlatching of latch plate 309 from tooth 311A requires removal of free-weight bias on cables 107A1 and 107A2 in order for block 307A to move downward and latch plate 309 to rotate in direction 310 and fully disengage from ratchet 303.

Upon de-energizing solenoid 319, compression spring 327 rotates latch 309 to the latched position. The corresponding right side ratchet 303B, engagement block 307B, and guide 305B components are not shown, but are similar in construction and operation to the left side components.

In the preferred embodiments, solenoid 319 is energized through pressure-sensitive switches on the free-weight assembly as in the embodiment of FIGS. 7, 9 and the electrical schematic diagram of FIG. 10. The fixed ratchet embodiment of FIGS. 11A and 11B reduces the cost of the apparatus of the earlier embodiment by eliminating the chain loop assemblies, positioner and associated controls. The fixed ratchet embodiment requires that the user support most, or in the most preferred embodiments, all of the weight of the free-weight assembly in order to unlatch the engagement blocks from the ratchets and allow downward movement of the free-weight assembly. This embodiment also provides immediate latching of the engagement blocks to fully support the free-weight assembly when the user releases a pressure-sensitive switch on the free-weights.

Another embodiment combines the linear guide with the weight-support assembly as a single integrated component. For example, the linear ratchet 303A of FIG. 11B may act as both the linear guide and weight support assembly by modification of block 307A to act as a linear follower to ratchet bar 303A.

Figure 12:
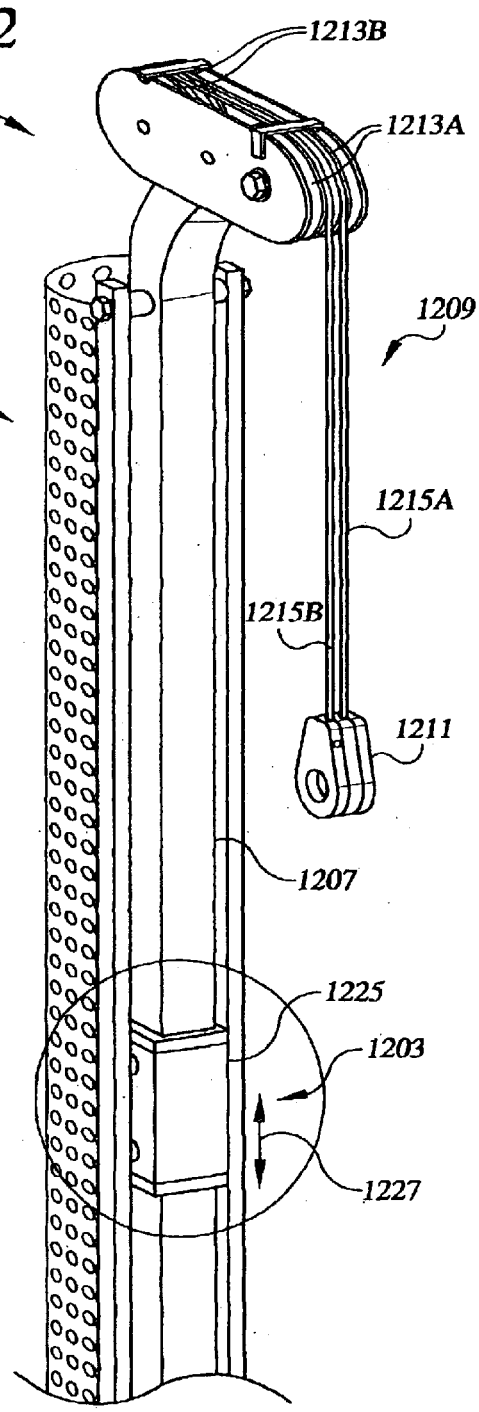
FIG. 12 is a perspective drawing of a weight-responsive engagement assembly having a solenoid-operated pawl which engages one of a plurality of holes in a vertical column acting as a weight-support assembly of a self-spotting apparatus.

FIG. 12 is a perspective drawing of embodiment 1201 of a weight responsive engagement assembly 1203 and weight support assembly 1205 of the present invention. Weight support assembly 1205 consists of a load-bearing column 1207 supported vertically from a frame of the apparatus such as the frame 103 of FIG. 1. Cable assembly 1209 connects engagement assembly 1203 to a free weight assembly (not shown) via cable attachment assembly 1211. Sheaves 1213A and 1213B support cables 1215A, 1215B, similar to the sheaves of FIG. 1.

Figure 12A:
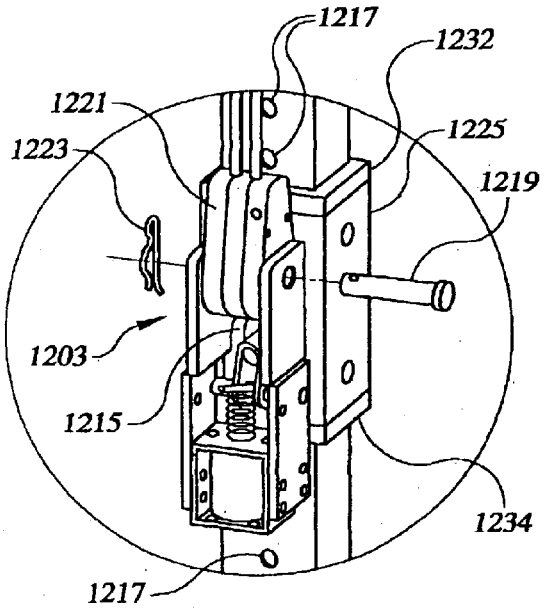
FIG. 12A is a detail perspective showing the weight-responsive engagement assembly of FIG. 12 including the solenoid, pawl, vertical column guide, and cable connector.

Engagement assembly 1203, better shown in detail perspective drawing FIG. 12A, utilizes a pawl of pawl assembly 1215 which engages one of a plurality of vertically-spaced holes 1217 in column 1207 of support assembly 1205. Pin 1219 retains attachment assembly 1221 of cable assembly 1209 to weight engagement assembly 1203. Clip 1223 retains pin 1219 in engagement with engagement assembly 1203 and attachment assembly 1221.

Weight responsive engagement assembly 1203 comprises a tubular guide 1225 which comprises a sliding fit on column 1207. Guide 1225 serves as a vertical guide for engagement assembly 1203 by constraining motion to vertical (along column 1207) motion as shown by arrow 1227. Upper guide bushing 1232 and lower guide bushing 1234 provide a close-clearance bearing surface to improve alignment and reduce friction of guide 1225 on column 1207.

Figure 13:
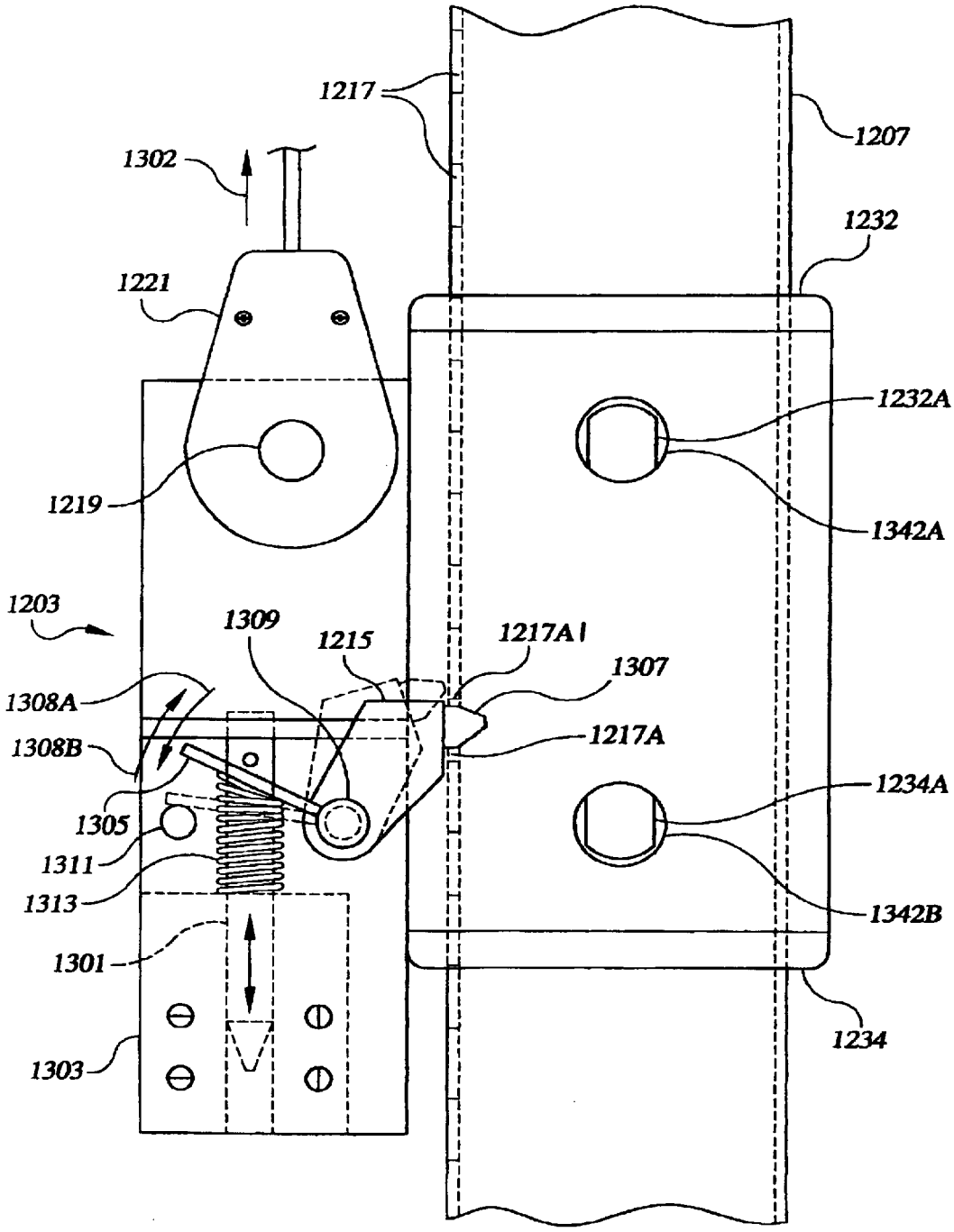
FIG. 13 is a side elevation drawing of the weight-responsive engagement assembly and the weight support assembly of FIG. 12 showing engagement of the pawl in a hole of the support column.

FIG. 13 is a side elevation drawing of a pawl 1307 of pawl assembly 1215 of weight engagement assembly 1203 engaging hole 1217A of column 1207. Armature 1301 of solenoid 1303 pulls downward on lever 1305 of pawl assembly 1215 to bias pawl 1307 in a disengaged direction 1308A. Pawl assembly 1215 pivots about pivot pin 1309 to engage and disengage pawl 1307 from the holes of column 1207. Stop 1311 provides a limit to the withdrawn position of pawl assembly 1215, shown in phantom lines. Helical spring 1313, acting on lever 1305, provides bias on pawl assembly 1215 in the engaging direction 1308B. Holes 1342A, 1342B retain tabs 1232A, 1234A of bushings 1232 and 1234.

FIG. 14A is an elevation and partial cross sectional drawing of pawl assembly 1215 of FIG. 13. Pivot collar 1401 provides a bushing for pivot pin 1309 and defines a center of rotation 1403 of pawl assembly 1215. Lever 1305 connects to collar 1401. Pawl frame 1405 connects pawl 1307 to collar 1401. In the preferred embodiments, pawl head 1407 of pawl 1307 is displaced in two perpendicular axes from the center of rotation 1403, as shown by vertical displacement 1409 and horizontal displacement 1411. FIG. 14B is a back end view of pawl assembly 1215.

FIG. 15A is a side elevation drawing of pawl 1307 showing a preferred embodiment of the shape of pawl body 1501 and tapered pawl head 1407. Pawl body 1501 is a cylindrical shape and defines a longitudinal axis 1503. Pawl 1307 is shown in the orientation of FIG. 13 with longitudinal axis 1503 generally horizontal.

In the preferred embodiments, pawl head 1407 is generally conical in shape, with a lower head portion 1505 forming an included angle 1507 with longitudinal axis 1503 larger than the included angle 1509 of upper head portion 1511 with longitudinal axis 1503.

FIG. 15B is an end view of pawl 1307 looking from the distal end of the pawl and shows truncated end portion 1513 asymmetrical to longitudinal axis 1503. The periphery of end portion 1513 is shown displace inwardly from both vertical and horizontal axis with respect to pawl body 1501. This displacement provides centering and alignment in both vertical and horizontal directions of pawl head 1407 into holes 1217 of column 1207. Adequate alignment of pawl head 1407 into holes 1217 is critical to proper function of the apparatus, especially due to partial misalignment of components such as engagement assembly 1203 to column 1207 due to stresses and component tolerances.

In order to provide stable engagement of pawl 1307 under load, at least a portion 1515 of upper pawl body 1501 is parallel to longitudinal axis 1503 (horizontal), or angled upward towards pawl end 1503. In the more preferred embodiments, at least a portion 1517 of lower pawl body 1501 is parallel to longitudinal axis 1503 (horizontal), or angled downwards from pawl end 1503. FIG. 15C shows an alternative embodiment of a pawl 1521 looking at pawl head end 1523. Lower pawl head portion 1527 is angled more to longitudinal axis of body 1525 than upper pawl head portion 1529 so that end portion 1523 is asymmetrical to axis 1526. In less preferred embodiments, end portions 1523 of FIG. 15C and 1513 of FIG. 15B are symmetrical about the respective longitudinal axes.

In the preferred embodiments; the geometric center 1504 of distal end portion 1513 is displaced vertically above the geometric center (at axis 1503) of the proximal end of pawl head 1407. In another embodiment, the center of height (1504A) of a vertical cross section of distal end portion 1513 is displaced vertically above the center of height (at axis 1503) of a vertical cross section of the proximal end of pawl head 1407.

The resulting shape, along with the non-tapered portion 1515 on the upper portion of the pawl body 1501 improves the engageablility and stability of pawl 1307 engagement with a hole in the column such as hole 1217A of FIG. 13. For example, the engagement of pawl 1307 in hole 1217A is stabilized by the non-tapered portion 1515 of pawl 1307 loaded against the upper portion 1217A1 of hole 1217A by an upward force on cable attachment assembly 1221 resulting from the hanging weight of a free-weight on the apparatus (shown by arrow 1302). Friction between horizorital or non-tapered upper portion 1515 of pawl 1307 and the upper portion of hole 1217A prevents withdrawal of pawl 1307 until at least a portion of the load of a hanging free-weight is removed, for example by partially or totally lifting of the free-weight by the user. Even the withdrawal bias of solenoid 1303 is insufficient to withdraw pawl 1307 until the weight load is reduced or removed.

Figure 16:
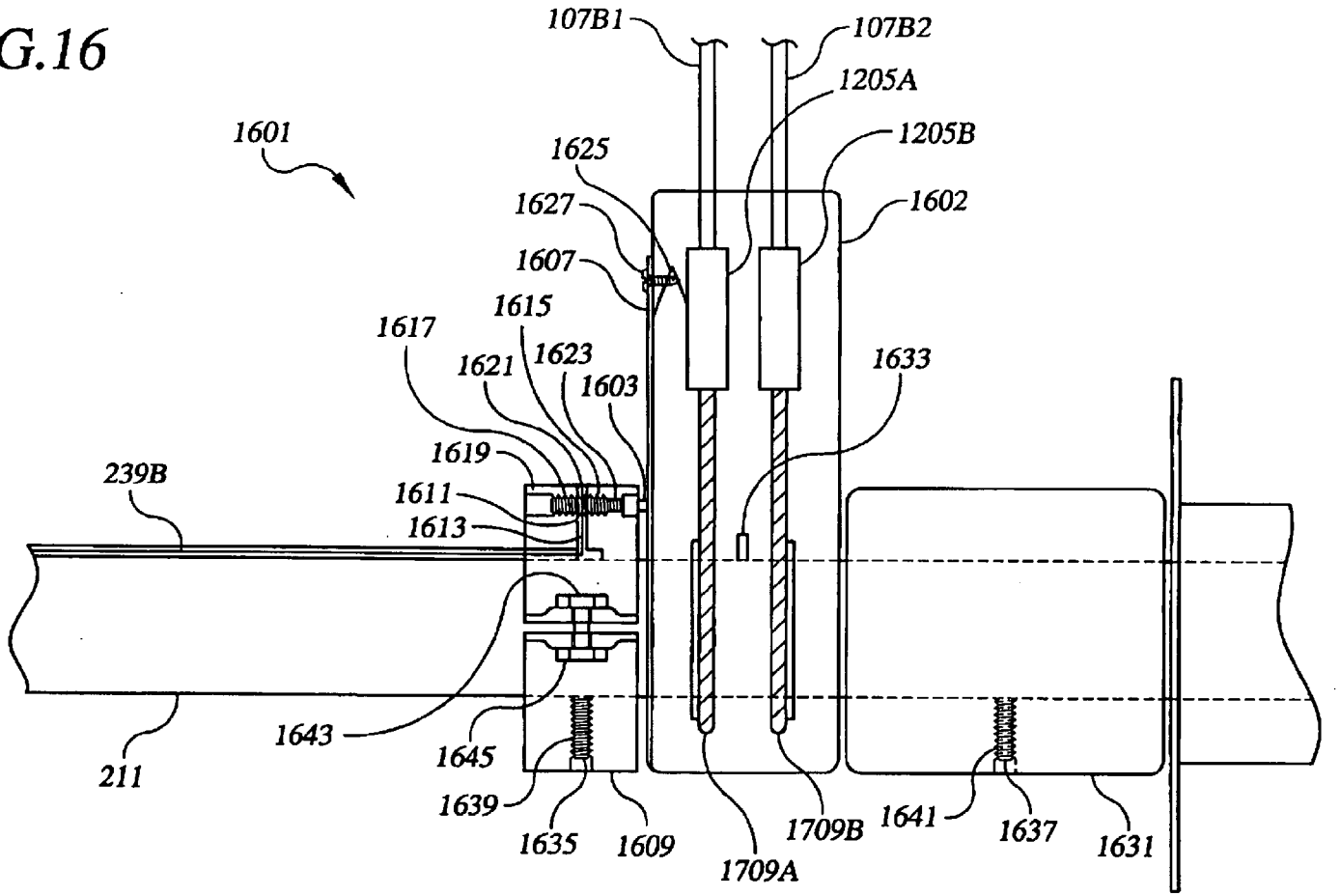
FIG. 16 is a schematic drawing of the cable attachment assembly having an inner collar fixed to the bar of the free-weight, and a brush contact electrically connected to a grip sensor on the bar, a cable support collar having a journal for engagement with the bar and having a slip ring in contact with the brush of the inner collar, and an outer collar fixed to the bar maintaining axial position of the support collar on the bar.

FIG. 16 is a schematic drawing of a preferred embodiment of a novel cable attachment assembly 1601 for connecting a grip sensor such as a pressure sensitive switch or touch sensor 239B on bar 211 to cable 107B1. A brush 1603 on inside collar 1609 contacts slip ring 1607 of support collar 1602 to transfer an electrical signal from sensor 239B to cable 107B1.

Inner collar 1609 utilizes a drilled passage 1611 for routing lead 1613 of touch sensor 239B between inner setscrew 1615 and outer setscrew 1617 of threaded bore 1619 at connection 1621. Helical spring 1623 provides bias on brush 1603 to make sliding electrical contact with slip ring 1607 and provides electrical contact between inner set screw 1615 and brush 1603. Spring clip 1625 retained by screw 1627 provides electrical contact between slip ring 1607 of support collar 1602 and cable 107B1 at crimp connector 1205A.

Inner collar 1609 and outer collar 1631 are clamped to bar 211 by set screws 1635, 1637 in threaded bores 1639, 1641. Alternatively, the collars may be split collars and clamped to bar 211 by clamp screw 1643 and clamp nut 1645 of collar 1609. The clamping arrangement retains support collar 1602 in the desired axial location on bar 211 while allowing rotation of bar 211 with respect to support collar 1602.

Figure 17B:
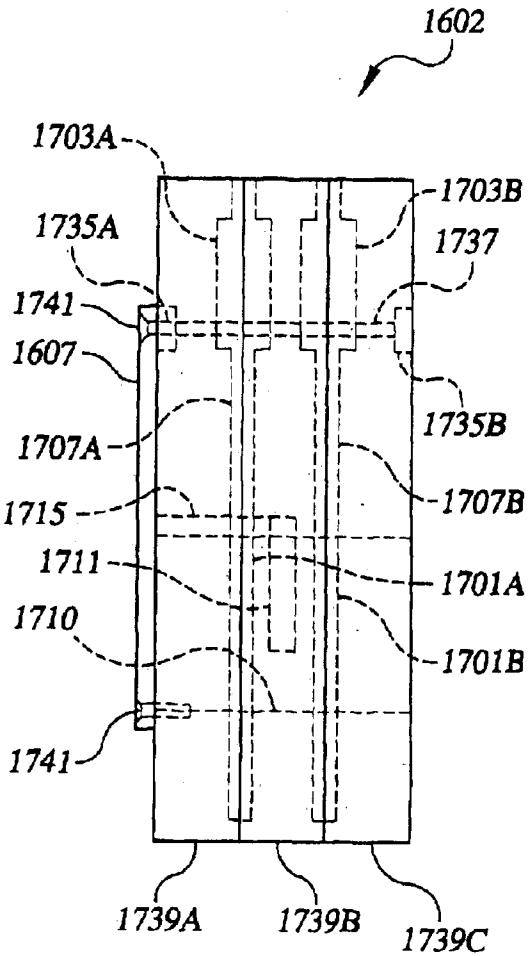
FIG. 17B is a front view of the support collar of FIG. 16.
Figure 17A:
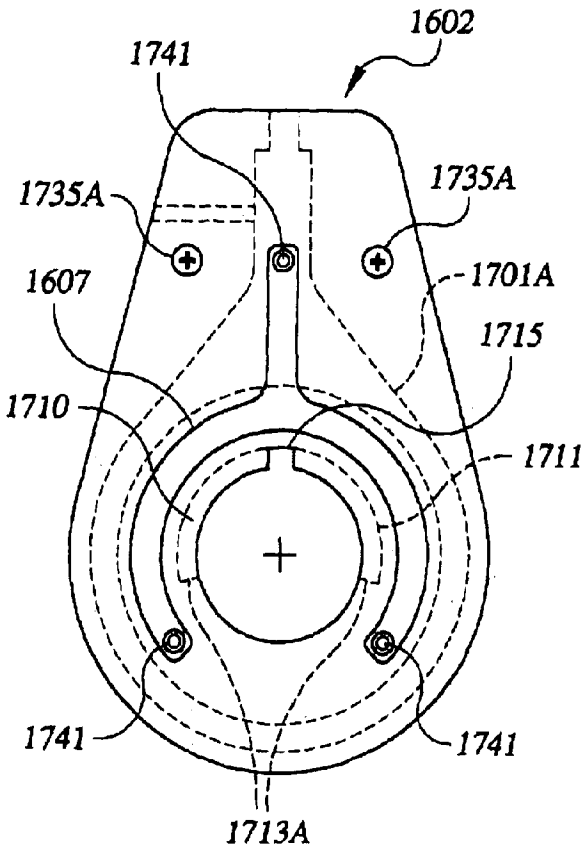
FIG. 17A is a side elevation drawing of the support collar of FIG. 16.

FIG. 17 is a side elevation drawing and FIG. 17B is a front view of support collar 1602. Grooves 1707A, 1707B of support collar 1602 provide an attachment means for cables 107B1 and 107B2 of FIG. 16. Groove portions 1701A, 1701B provide space for cable loops 1709A, 1709B of FIG. 16. Groove portions 1703A, 1703B provide space for crimp connectors 1205A, 1205B of cables 107B1, 107B2. Journal 1710 provides a means for supporting bar 211 yet allowing rotation of bar 211 with respect to support collar 1602.

Groove 1711 of assembly 1601 provides space for lug 1633 of bar 211 and allows rotation of bar 211 with respect to support collar 1602 until lug 1633 contacts groove ends 1713A of groove 1711. Groove 1711 acts as a stop to prevent rotation of bar 211 so that grip sensor 239B becomes disengaged from the hands of the user. Keyway 1715 provides a means to insert support collar 1602 on onto bar 211 with lug 1633 in groove 1711. Screws 1735A and nuts 1735B retained in drilled holes 1737 clamp portions 1739A, 1739B and 1739C of collar 1602. Screws 1741 retain slip ring 1607 on the assembly. In the preferred embodiments, collars 1609, 1602 and 1631 are made of high-strength plastic and may be injection molded, die cast, or fabricated and machined.

Figure 18:
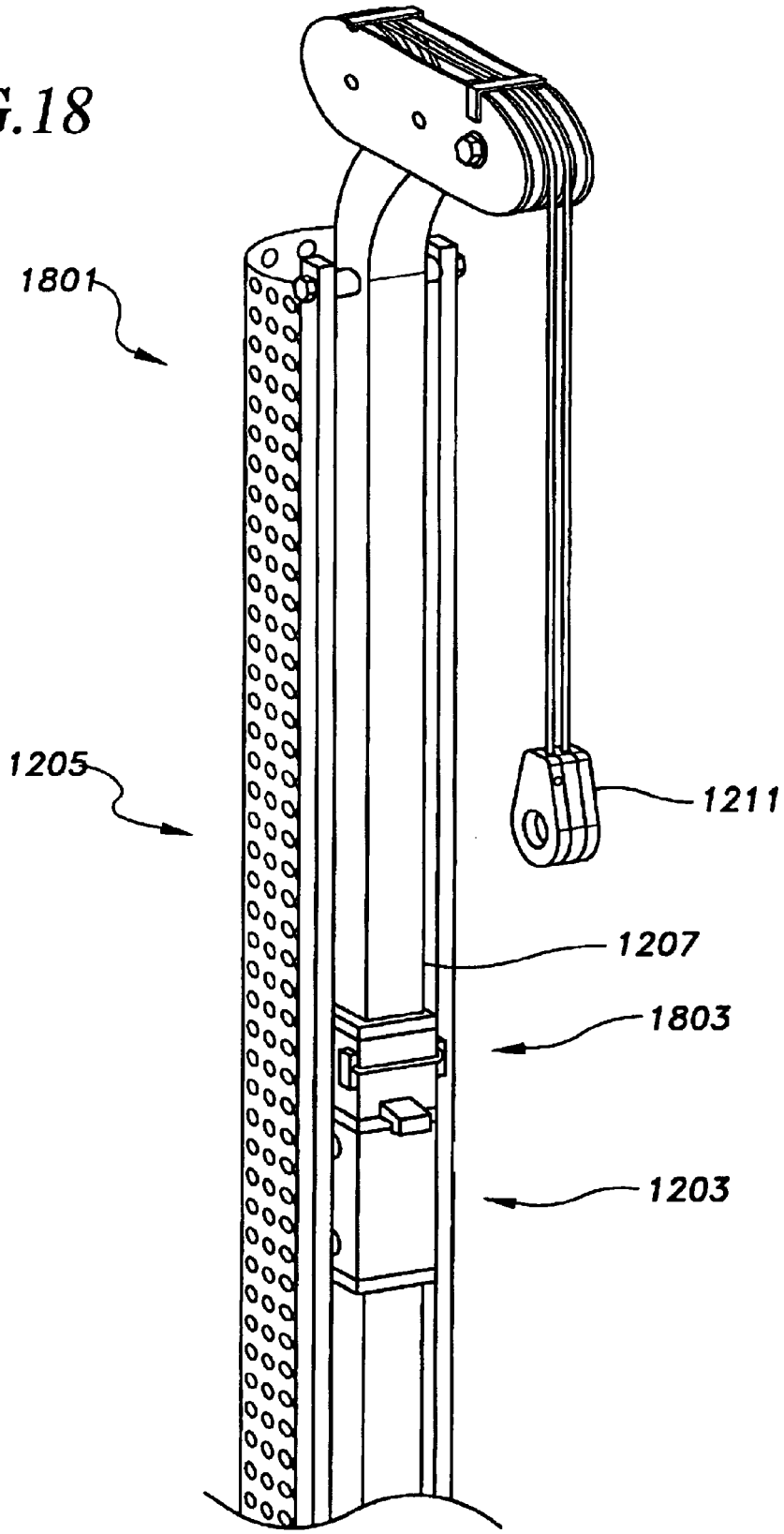
FIG. 18 is a perspective drawing of a manually adjusted auxiliary stop for use with the weight engagement assembly and weight support assembly of a preferred embodiment of the invention.

FIG. 18 is a perspective drawing of alternative embodiment 1801 of the weight responsive engagement assembly 1203 and weight support assembly 1205 of the apparatus of FIG. 12. Auxiliary weight support engagement assembly or stop 1803 engages load-bearing or support column 1207 of weight support assembly 1205 and acts as a secondary stop to limit upward motion of weight-responsive engagement assembly 1203. By limiting the upward motion of weight-responsive engagement assembly 1203, stop 1803 defines the lowest position of a free-weight assembly attached to cable attachment assembly 1211. Stop 1803 is positionable along column 1207 of weight support assembly 1205. Only one stop is shown in the figure, but an opposite side stop for use with a second weight support column is similar.

Figure 19:
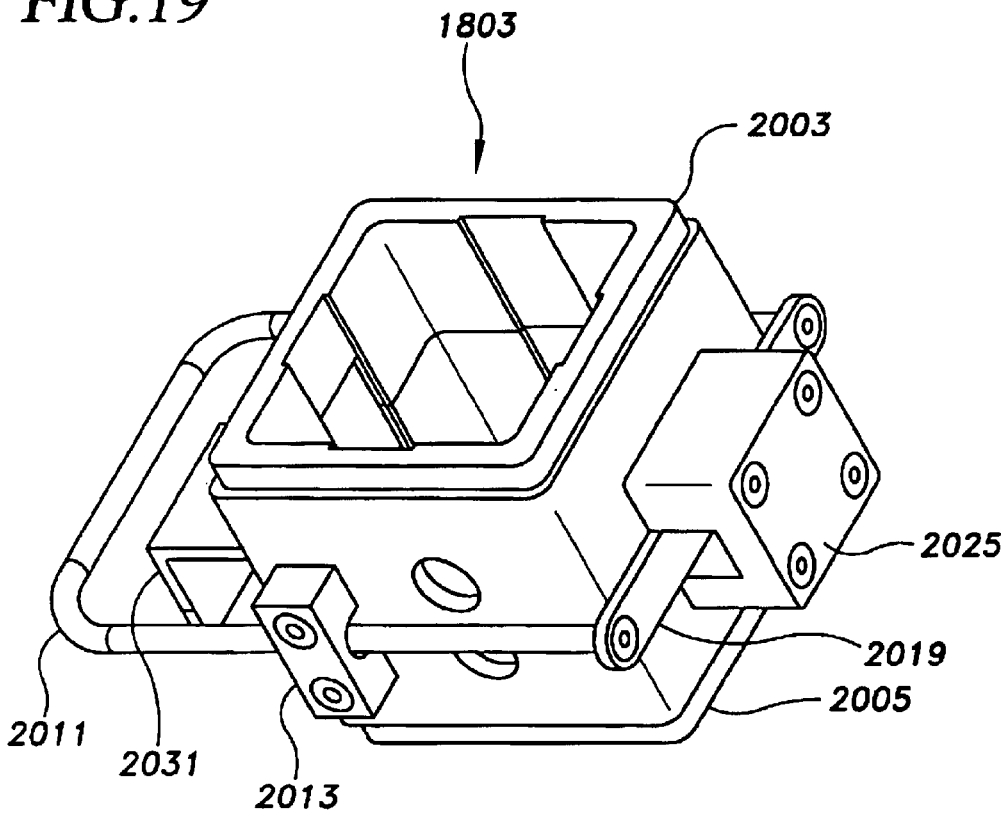
FIG. 19 is a perspective detail drawing of the auxiliary stop of FIG. 18.
Figure 20:
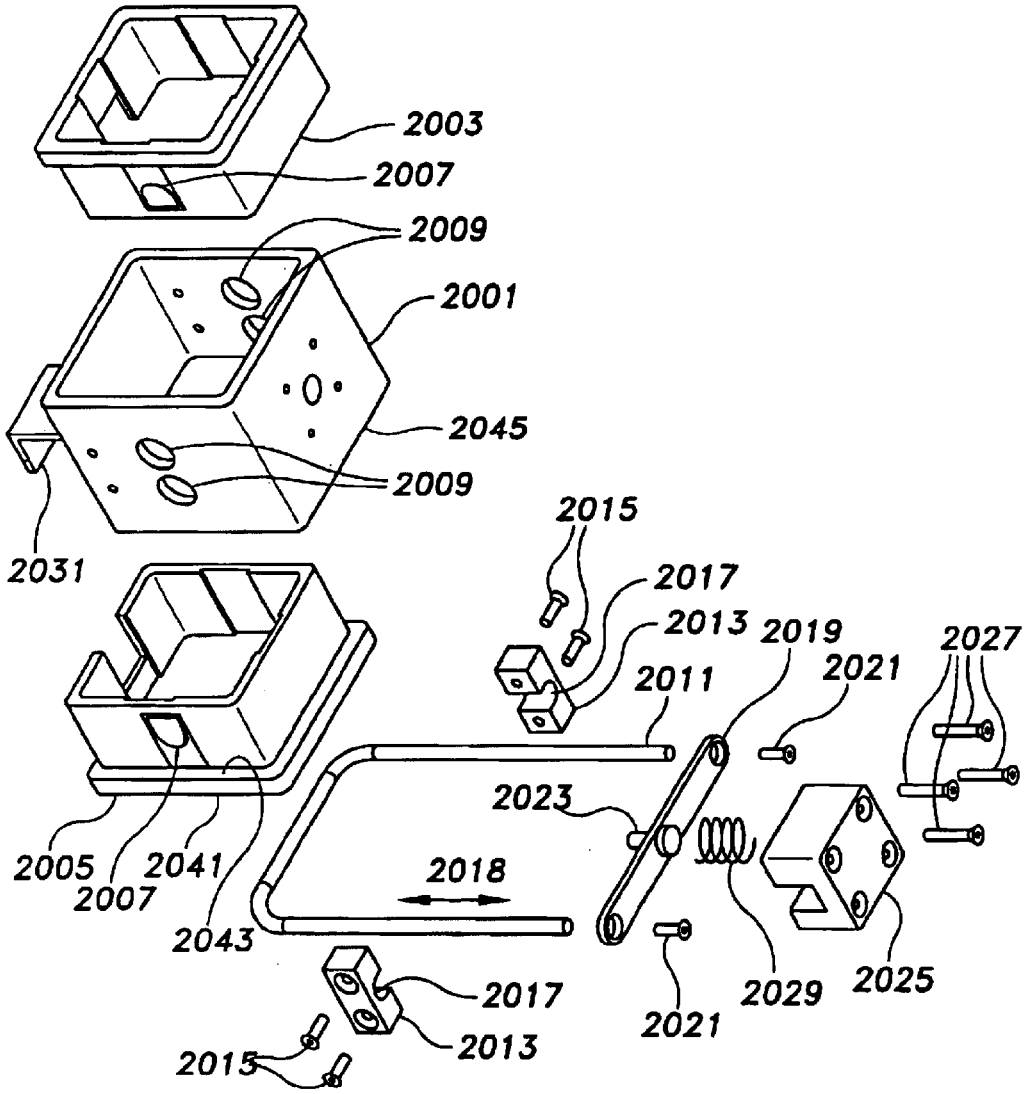
FIG. 20 is an exploded view of the auxiliary stop of FIG. 18 showing a rectangular frame, top and bottom frame bushings, adjustment bar, engagement pin, bias spring and linear bushings.

FIG. 19 is a perspective drawing of stop 1803 and FIG. 20 is an exploded drawing of the stop showing columnar frame 2001, top frame bushing 2003 and bottom frame bushing 2005. Top and bottom frame bushings 2003, 2005 are made of a polymer such as polyamide to provide a low-friction bearing surface against column 1207. Resilient engagement buttons 2007 of top and bottom bushings 2003, 2005 engage holes 2009 of frame 2001 to secure the bushings to frame 2001. Disengagement or adjustment bar 2011, secured to frame 2001 by bearing or attachment blocks 2013 and screws 2015, provide bearing surfaces 2017 to allow longitudinal sliding movement 2018 of adjustment bar 2011 with respect to frame 2001. Other disengagement elements such as pivoted bars or levers may be used.

Cross beam 2019, attached to the ends of adjustment bar 2011 by screws 2021 provides a means of attachment of auxiliary column engagement pawl or pin 2023 to bar 2011. Block 2025, attached to frame 2001 by screws 2027 acts as a guide for cross beam 2019. Helical spring 2029 biases pin 2023 inward with respect to frame 2001. Hand grip 2031 provides a convenient means for manual adjustment of stop 1803 position.

Figure 21A:
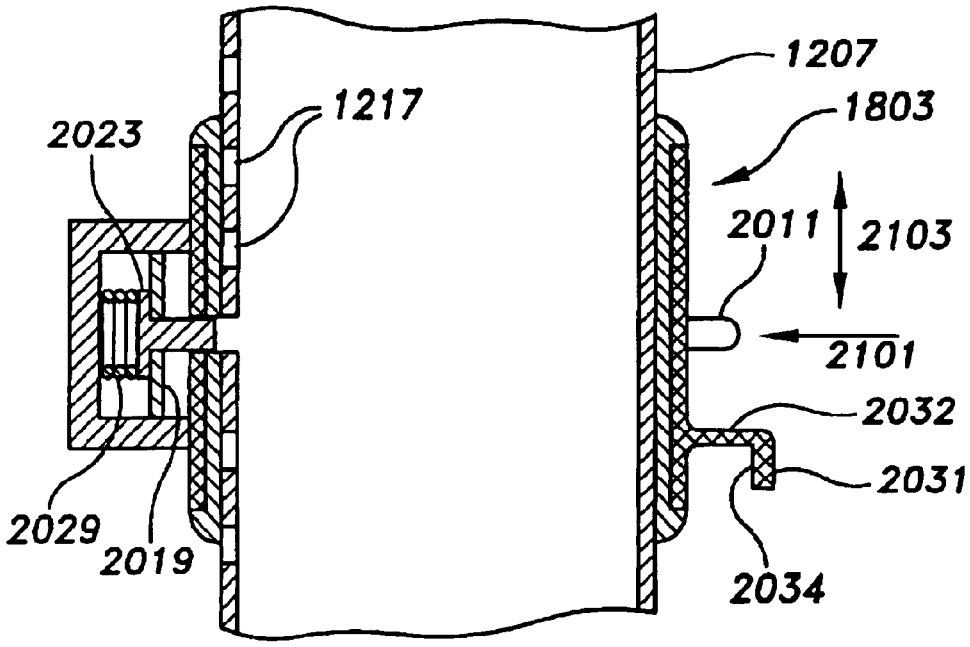
FIG. 21A is a cross sectional drawing of the auxiliary stop assembled on a weight support column showing the adjustment or disengagement bar depressed to disengage the engagement pin from the support holes in the support column.

FIG. 21A is an elevation cross sectional drawing of stop 1803 and support column 1207. In this figure, adjustment bar 2011 is depressed, for example by finger or hand pressure in direction 2101, withdrawing pin 2023 against spring 2029 bias. In the withdrawn position, pin 2023 does not engage holes such as holes 1217 of column 1207, and stop 1803 is free to move up and down along column 1207 in vertical directions 2103. In the preferred embodiments, stop 1803 forms a sliding clearance with column 1207. Hand grip 2031 has an outwardly extending portion 2032 providing surfaces for raising and lowering stop 1803 and a vertically extending portion 2034 providing a reaction surface for insertion of bar 2011 by a hand.

Figure 21B:
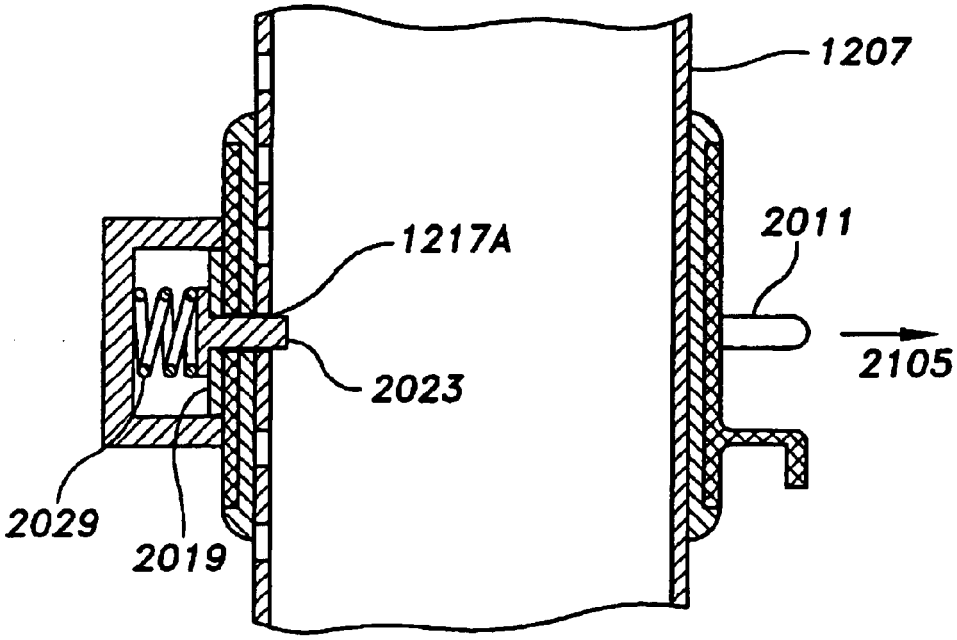
FIG. 21B is a cross sectional drawing of the auxiliary stop assembled on a weight support column showing the adjustment or disengagement bar released and the spring biasing the engagement pin in one of the support holes in the support column.

FIG. 21B is an elevation cross sectional drawing of stop 1803 and column 1207 with adjustment bar 2011 released. Helical spring 2029 biases cross bar 2019, pin 2023, and adjustment bar 2011 in the direction of arrow 2105. Upon alignment of a hole such as hole 1217A in column 1207 with pin 2023, helical spring 2029 biases pin 2023 into hole 1217A and fixes stop 1803 to support column 1207.

Figure 22:
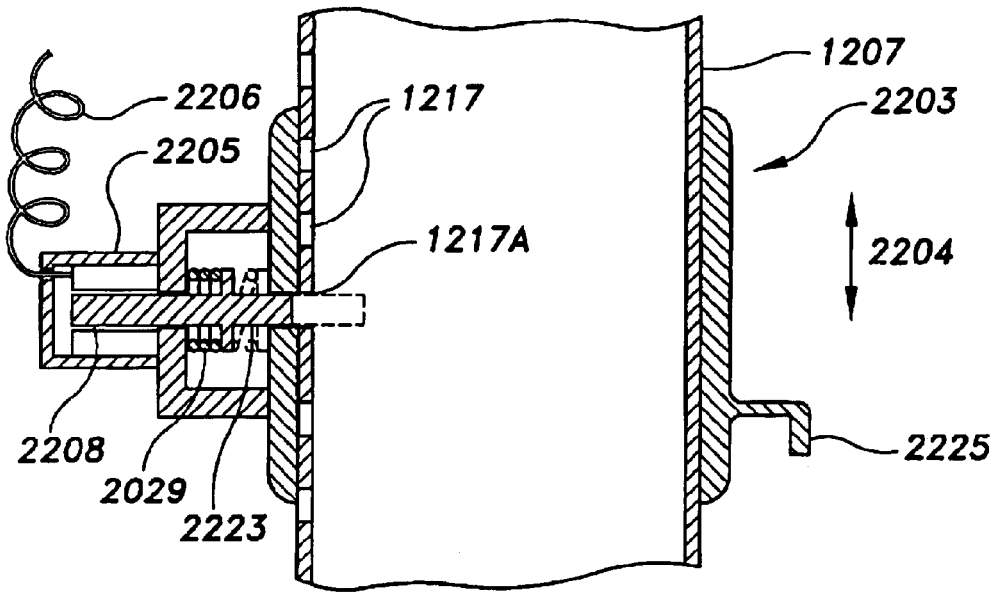
FIG. 22 is a cross sectional drawing of an alternative embodiment of the auxiliary stop utilizing a solenoid as a disengagement means.

FIG. 22 is an elevation cross sectional drawing of another embodiment of auxiliary weight support engagement assembly or stop 2203 utilizing a solenoid such as disengagement solenoid 2205 to withdraw pin 2223 and allow upwards and downwards movement of stop 2203 along column 1207 in vertical directions 2204. Energizing disengagement solenoid 2205 through coiled cable 2206 causes a magnetizing attraction to armature end 2208 of pin 2223 and withdraws pin 2223 in the position shown. Upon de-energizing solenoid 2205, helical spring 2029 biases pin 2223 towards the center of column 1207, and upon alignment of a hole in column 1207 such as hole 1217A, pin 2223 is biased in a locking position as shown in the phantom lines.

Figure 23:
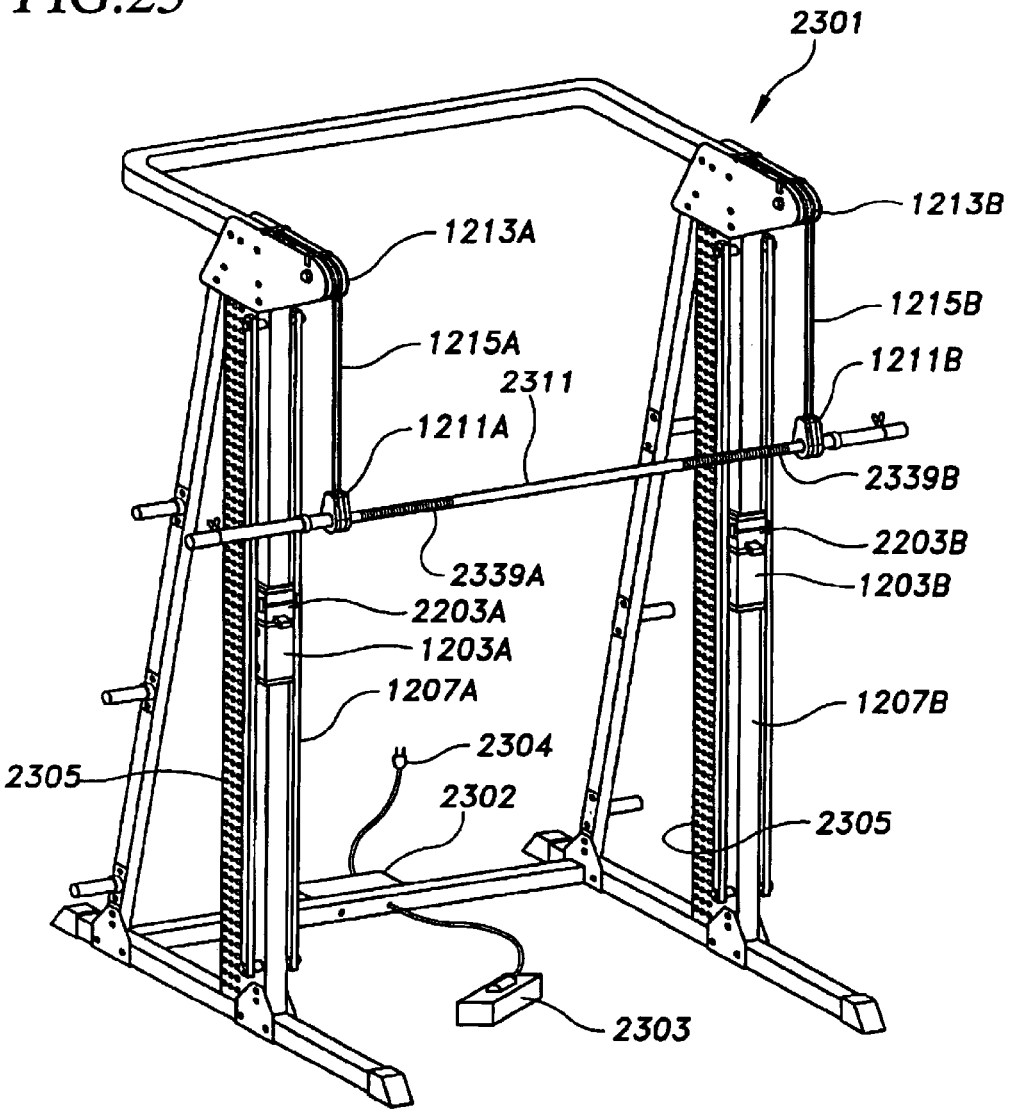
FIG. 23 is a perspective drawing of an embodiment of the self-spotting free-weight apparatus utilizing an auxiliary stop on each of the weight support assemblies to limit downward movement of the free-weights.

FIG. 23 is a perspective drawing of embodiment 2301 of a self-spotting apparatus for free-weights utilizing stops 2203A, 2203B to limit the lowest position of free-weight bar 2311. Free-weight bar 2311 is shown without weights attached for clarity. Cable attachment assemblies 1211A, 1211B attach bar 2311 to respective weight-responsive engagement assemblies 1203A, 1203B via cable assemblies 1215A, 12115B, and pulleys 1213A, 1213B, similar to the apparatus of FIGS. 12 and 12A. Weight-responsive engagement assemblies 1203A, 1203B engage holes in respective support columns 1207A, 1207B as described in the apparatus of FIGS. 12 and 12A.

Actuation of grip sensors 2339A, 2339B by the hands of a user energize respective solenoids 1303 of FIG. 13, disengaging pawl assembly 1215 and allowing weight-responsive engagement assemblies 1203A, 1203B to lower as free-weight bar 2311 is raised by the user. When bar 2311 is lowered by the user, weight-responsive engagement assemblies 1203A, 1203B rise vertically along columns 1207A, 1207B until either the user releases one of the grip sensors 2339A, 2339B as described previously, or the weight-responsive engagement assemblies contact stops 1203A, 1203B. Bottom surface 2041 of bottom frame bushing 2005 of FIG. 20 provides a bearing surface for retaining upward force from weight-responsive engagement assemblies 1203A, 1203B. Support ledge 2043 engages bottom surface 2045 of frame 2001 to provide support to bearing surface 2041.

Disengagement solenoids (2205 of FIG. 22) of stops 2203A, 2203B are energized upon activation of foot switch 2303 by the user. Control unit 2302, powered from ac receptacle 2304 provides control of disengagement solenoids 1303A, 1303B of weight-responsive engagement assemblies 1202A, 1203B and auxiliary stop solenoids 2205A, 2205B. Upon activation of foot switch 2303, stops 2203A, 2203B will fall by gravity to the location of weight-responsive engagement assemblies 1203A, 1203B. Alternatively, stops 2203A, 2203B are adjusted manually by the user by hand grips 2225 of the stops while foot switch 2303 is activated. Electrical connecting cables such as cable 2206 of FIG. 22 may be supported by various cable conduits or supports from the frame (not shown) or run internally through framing members or covers such as weight support assembly covers 2305.

Figure 24:
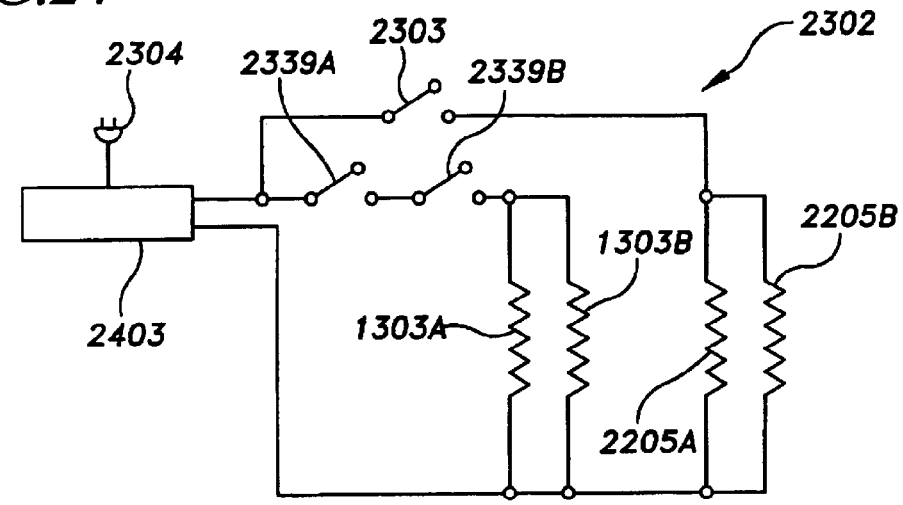
FIG. 24 is an electrical schematic diagram of the control unit for weight-responsive engagement assembly solenoids and auxiliary stop solenoids of the apparatus of FIG. 23.

FIG. 24 is an electrical schematic diagram of the apparatus of FIG. 23 showing dc power supply 2403 powered from ac receptacle 2304. Weight-responsive engagement assembly solenoids 1303A, 1303B are energized by grip sensor contacts 2339A, 2339B connected in series so opening of either grip sensor will de-energize solenoids 1303A, 1303B. De-energizing solenoids 1303A, 1303B results in engagement of the respective weight-responsive engagement assemblies 1203A, 1203B to the respective support columns 1207A, 1207B as described in earlier embodiments. Grip sensor contacts 2339A, 2339B may be normally open grip switches such as switches 239A, 239B of FIG. 7, or they may be mechanical or electronic relay contacts, or microprocessor outputs of touch sensors such as those disclosed in U.S. application Ser. No. 09/746,184, hereby incorporated by reference.

Engaging foot switch 2303 shuts the normally-open contact and energizes solenoids 2205A, 2205B of respective stops 2203A, 2203B, allowing the stops to be adjusted to the desired location along columns 1207A, 1207B. Release of foot switch 2303 de-energizes both solenoids, resulting in the engagement of stops 2203A, 2203B to support columns 1207A, 1207B. The manually released stop 1803 of FIG. 18 and electrically-released stops 2203A, 2203B of FIG. 23 can be used with the dumbbell assemblies of FIG. 9.

Figure 25:
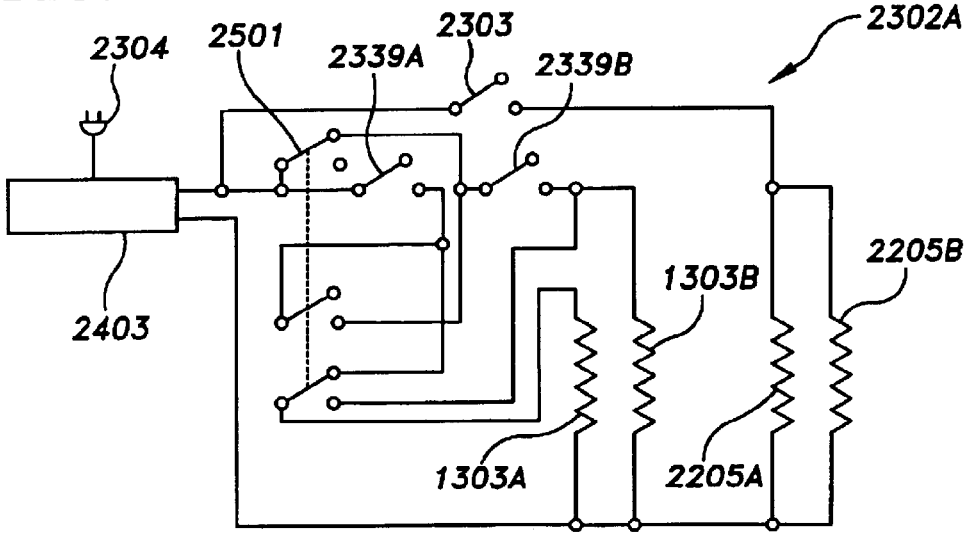
FIG. 25 is an electrical schematic diagram of an alternative embodiment of the control unit for weight-responsive engagement assembly solenoids and auxiliary stop solenoids of the apparatus of FIG. 23 utilizing a mode switch for selecting barbell or dumbbell logic.

FIG. 25 is an electrical schematic diagram of an alternative embodiment of control unit 2302 of FIG. 23 utilizing a mode switch 2501 for switching the grip sensor contacts from a barbell mode to a dumbbell mode. In the dumbbell mode, switch 2501 contacts (in the position showed in the figure) allow independent activation of respective weight-responsive engagement assembly solenoids 1303A, 1303B by the respective grip sensor contacts, (where contacts 2339A, 2339B are replaced by dumbbell switch contacts such as switch 267A of FIG. 9). In the barbell mode (alternate switch 2501 position), both grip sensor contacts 2339A, 2339B contacts must be activated to energize solenoids 1303A, 1303B as in FIG. 24.

Accordingly the reader will see that the SELF-SPOTTING APPARATUS FOR FREE-WEIGHTS provides a self-spotting free-weight exercise machine which provides user-controlled and automatic support to barbells and dumbbells. The device provides the following additional advantages:

The apparatus requires that the user lift the substantial weight of the free-weight before the support cables are disengaged from the support assemblies;

Once the free-weight is disengaged from the support assemblies, the user may exercise the free-weight in an independent manner, allowing unrestricted vertical movement of one end with respect to the other end;

Loosening of the grip by either hand of the user immediately engages the engagement blocks and locks the free-weight support cables to reduce the likelihood of dropping or injury;

Independent operation of the cables and pivoting support booms allows use of barbells or dumbbells;

Auxiliary stops provide a lower limit for free-weight travel; and

A dual-mode switch provides control of disengagement solenoids for both barbell and dumbbell use.

Although the description above contains many specifications, these should not be construed as limiting the scope of the invention but as merely providing illustrations of some of the presently preferred embodiments of this invention. For example, the columns of the weight support assembly may be inclined to the vertical. The auxiliary stops may be of circular or "C" shaped cross section. Thus the scope of the invention should be determined by the appended claims and their legal equivalents, rather than by the examples given.

I claim:

1. A self-spotting apparatus for free-weights comprising:

a frame;

an elongated weight support assembly attached to said frame;

a first weight engagement assembly operably attachable to said free-weights, translatable along said elongated weight support assembly towards a top end when said free-weights are lowered due to gravity and comprising a first engagement element selectively engageable with said elongated weight support assembly to prevent translation along said elongated weight support assembly towards said top end; and a second weight engagement assembly translatable along said elongated weight support assembly and disposed on said weight support assembly between said first weight engagement assembly and said top end and comprising a second engagement element selectively engageable to said elongated weight support assembly to prevent translation of said first weight engagement assembly towards said top end.

2. The self-spotting apparatus of claim 1 wherein said second weight engagement assembly comprises a spring operably attached to said second engagement element for biasing said second engagement element to engage said elongated weight support assembly.

3. The self-spotting apparatus of claim 2 wherein said second weight engagement assembly comprises a disengagement element operably attached to said second engagement element and comprising a first surface portion engageable by a hand of an operator, said disengagement element defining an engaged position of said second weight engagement assembly wherein said second engagement element is engaged to said elongated weight support assembly and a disengaged position of said second weight engagement assembly wherein said second engagement element is disengaged to said elongated weight support assembly when said first surface portion is engaged by said hand of said operator.

4. The self-spotting apparatus of claim 2 wherein said second weight engagement assembly comprises a solenoid operably connected to said second engagement element whereby said second weight engagement assembly is disengaged from said elongated weight support assembly when said solenoid is energized.

5. The self-spotting apparatus of claim 1 wherein said elongated weight support assembly is a column comprising a plurality of engagement holes and said second engagement element of said second weight engagement assembly is a pin engageable in one of said plurality of holes.

6. The self-spotting apparatus of claim 5 wherein said second weight engagement assembly comprises a frame comprising a rectangular cross section and a sliding clearance with said column.

7. The self-spotting apparatus of claim 1 wherein said second weight engagement assembly comprises a hand grip fixed to said second weight engagement assembly and extending outward from said second weight engagement assembly to define a lift surface whereby a hand of an operator can raise or lower said second weight engagement assembly along said elongated weight support assembly.

8. The self-spotting apparatus of claim 7 wherein said hand grip extends vertically from said second weight engagement assembly to define a reaction surface for hand engagement of a disengagement element operably attached to said second engagement element.

9. A stop assembly for limiting upward translation of a weight engagement assembly along an elongated weight support assembly of a free-weight apparatus comprising:

a frame portion comprising a rectangular cross sectional shape defining a sliding fit with said elongated weight support assembly;

an engagement element operably attached to the frame portion to define an engaged position with said engagement element biased inwardly from said frame by a bias element and a disengaged position with said engagement element retracted against the bias of said bias element by a disengagement element operably attached to said frame;

said engagement element is a pin attached to said disengagement element;

said bias element is a spring operably attached to said pin and said disengagement element;

a hand positioning grip extending outwardly from said frame whereby a hand of an operator can position said stop assembly along said elongated weight support assembly;

said hand positioning grip comprises a vertically extending portion providing a reaction surface for positioning said disengagement element against spring bias;

said disengagement element is a U-shaped bar supported by a sliding bearing on each of two sides of said frame portion; and a load bearing surface on a bottom portion of said stop assembly whereby said stop assembly prevents said upward translation of said weight engagement assembly.

10. The stop assembly of claim 9 wherein said pin is attached to a cross beam disposed on a back portion of said frame portion and insertable through an opening in said back portion of said frame and said spring is disposed between said cross beam and a back support plate attached to said back portion of said frame portion.

11. The stop assembly of claim 9 comprising an upper bushing insert of low friction polymer material attached to an inner portion of said frame portion.

12. The stop assembly of claim 11 comprising a lower bushing insert of low friction polymer material attached to an inner portion of said frame portion.

13. The stop assembly of claim 9 wherein said disengagement element is a solenoid attached to said frame portion and operably connected to said engagement element.

14. A self-spotting apparatus for barbells and dumbbells comprising:

a frame;

a first weight engagement assembly selectively translatable along a first elongated weight support assembly attached to said frame and comprising a first solenoid operably connected to a first engagement element whereby said first weight engagement assembly is disengaged from said first elongated weight support assembly when said first solenoid is energized;

a second weight engagement assembly selectively translatable along a second elongated weight support assembly attached to said frame and comprising a second solenoid operably connected to a second engagement element whereby said second weight engagement assembly is disengaged from said second elongated weight support assembly when said second solenoid is energized; and a control unit comprising a mode selector, said mode selector operably connecting a first dumbbell grip actuator to independently energize said first solenoid and a second dumbbell grip actuator to independently energize said second solenoid in a first mode and operably connecting a first barbell grip actuator through a series connection to a second barbell grip actuator to energize both said first solenoid and said second solenoid in a second mode.

* * * * *